US011913299B2

(12) United States Patent
Wijning

(10) Patent No.: US 11,913,299 B2
(45) Date of Patent: Feb. 27, 2024

(54) WELLBORE DRILLING TOP DRIVE SYSTEM AND OPERATIONAL METHODS

(71) Applicant: ITREC B.V., Schiedam (NL)

(72) Inventor: Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 169 days.

(21) Appl. No.: 17/607,520

(22) PCT Filed: May 1, 2020

(86) PCT No.: PCT/EP2020/062208
§ 371 (c)(1),
(2) Date: Oct. 29, 2021

(87) PCT Pub. No.: WO2020/221926
PCT Pub. Date: Nov. 5, 2020

(65) Prior Publication Data

US 2022/0213733 A1 Jul. 7, 2022

(30) Foreign Application Priority Data

May 2, 2019 (NL) ..... 2023058

(51) Int. Cl.
*E21B 3/02* (2006.01)
*E21B 19/06* (2006.01)

(52) U.S. Cl.
CPC ..... *E21B 3/022* (2020.05); *E21B 19/06* (2013.01)

(58) Field of Classification Search
CPC ..... E21B 3/035; E21B 3/022; E21B 19/06
See application file for complete search history.

(56) References Cited

U.S. PATENT DOCUMENTS 5,251,709 A 10/1993 Richardson
7,191,840 B2 * 3/2007 Pietras ..... E21B 19/00 166/85.1

(Continued)

FOREIGN PATENT DOCUMENTS

EP 0 286 302 A2 10/1988
GB 2 228 025 A 8/1990

(Continued)

OTHER PUBLICATIONS

Dutch Search Report, issued in Priority Application No. 2023058, dated Dec. 13, 2019.

(Continued)

*Primary Examiner* — Christopher J Sebesta
(74) *Attorney, Agent, or Firm* — Birch, Stewart, Kolasch & Birch, LLP

(57) ABSTRACT

A top drive system for wellbore related activities involving a drilling tubulars string. The system includes a frame structure and a top drive device with one or more top drive motors, a transmission housing, a floating quill system with a hollow vertical floating quill shaft. The top drive device has a thrust bearing housing arranged below the transmission housing and suspended via said first and second vertical frame members from the top frame member. A hollow vertical outer main shaft is suspended from the thrust bearing housing and a hollow vertical inner main shaft is arranged vertically mobile within the outer main shaft. The inner main shaft is connected to the floating quill shaft and has a lower connector end that is configured to be connected to a drilling tubulars string via a threaded connection, so as to allow for transmission of the rotary torque from the one or more top drive motors via the transmission, the floating quill shaft, the inner main shaft, to the threadedly connected drilling tubular string.

18 Claims, 14 Drawing Sheets

(56) References Cited

U.S. PATENT DOCUMENTS

| | | | | |
|---|---|---|---|---|
| 7,735,565 | B2 | 6/2010 | Wells et al. | |
| 2007/0140801 | A1 | 6/2007 | Kuttel et al. | |
| 2013/0284459 | A1* | 10/2013 | Weintraub | F16C 17/04 384/129 |
| 2016/0024862 | A1* | 1/2016 | Wilson | E21B 19/166 166/380 |
| 2016/0145954 | A1* | 5/2016 | Helms | E21B 19/06 175/57 |
| 2018/0298693 | A1 | 10/2018 | Van Duivendijk et al. | |
| 2018/0298694 | A1 | 10/2018 | Van Duivendijk et al. | |

FOREIGN PATENT DOCUMENTS

| | | | |
|---|---|---|---|
| WO | WO 2010/120507 | A2 | 10/2010 |
| WO | WO 2014/178709 | A1 | 11/2014 |
| WO | WO 2014/182160 | A2 | 11/2014 |
| WO | WO 2017/065604 | A1 | 4/2017 |
| WO | WO 2017/132105 | A1 | 8/2017 |
| WO | WO 2019/036317 | A1 | 2/2019 |

OTHER PUBLICATIONS

International Search Report, issued in PCT/EP2020/062208, dated Jul. 16, 2020.
Written Opinion of the International Searching Authority, issued in PCT/EP2020/062208, dated Jul. 16, 2020.

* cited by examiner

WELLBORE DRILLING TOP DRIVE SYSTEM AND OPERATIONAL METHODS

FIELD OF THE INVENTION

The present invention relates to a top drive system for drilling a wellbore and other wellbore related activities involving a drilling tubulars string. The present invention also relates to a wellbore drilling installation with a trolley and a top drive system, e.g. mounted on an offshore drilling vessel.

BACKGROUND OF THE INVENTION

In WO2014/182160 an offshore vessel with a wellbore drilling installation is disclosed which comprises:

- drilling tower,
- a drill floor having a well centre through which a drilling tubulars string can pass along a firing line,
- at least one vertical trolley rail supported by the drilling tower,
- a trolley, said trolley being guided along said at least one vertical trolley rail,
- a top drive device attached to the trolley, said top drive device comprising one or more top drive motors, e.g. electric top drive motors, and a rotary quill extending in said firing line and being driven by said one or more motors in order to impart rotary motion to a drilling tubulars string when connected to the quill of the top drive, and
- a main hoisting device adapted to move the trolley with the top drive device up and down along said at least one vertical trolley rails.

In WO2014/178709 a wellbore drilling installation is disclosed wherein a trolley comprises a frame with a top frame member suspended from one or more winch driven cables of a main hoisting device, and with first and second vertical frame members that are each connected at an upper end thereof to the top frame member. These first and second vertical frame members depend from the top frame member at locations that are spaced apart from one another. The top drive device is attached to the frame via bails that are attached to the gearbox of the top drive and a hook arrangement on the top frame member. Thereby the top drive device is supported by the frame independent from the first and second vertical members. These first and second vertical members carry at their lower ends a cross beam which supports, in an embodiment, a rotatable tubular stem via a thrust bearing. The stem is adapted to be connected, via a threaded portion at its lower end, to the top end of a drilling tubulars string that passes along the firing line into the wellbore. The top drive device is connectable to the upper end of the tubular stem so that drilling can be performed by rotating the drilling tubulars string. The load of a drilling tubulars string is transmitted via the thrust bearing and the crossbeam to the first and second vertical frame members and thereby to the top frame member that is suspended from the main hoisting device.

In WO2017/065604 a wellbore drilling installation is disclosed wherein a trolley is guided along said at least one vertical trolley rail, and wherein a main hoisting device is adapted to lift and lower said trolley along said at least one vertical trolley rail relative to the drilling tower, e.g. said main hoisting device comprising one or more winch driven cables from which said trolley is suspended. A top drive device is attached to the trolley and comprises one or more top drive motors and a transmission to drive a quill of the top drive device. The trolley comprises a frame with:

- a top frame member suspended from said main hoisting device,
- a first vertical frame member and a second vertical frame member, each connected at an upper end thereof to said top frame member, said first and second vertical frame members depending from said top frame member spaced apart from one another and being adapted to support the load of a drilling tubulars string that passes along said firing line into the wellbore. Herein the top drive device is attached to the frame of the trolley independent from the first and second vertical frame members. The lower ends of the vertical frame members are connected to a rotatable head clamp assembly carrier that supports a rotatable head clamp assembly. This assembly is provided with an open-centred rotary body with a vertical passage there through that allows to lower the head clamp assembly from above over a top end of a drilling tubular in the firing line. The head clamp assembly is provided with a retainer assembly, e.g. a tool joint retainer assembly, that is embodied to axially retain the top end of the drilling tubular, e.g. a tool joint or box member at the top of said drilling tubular, whilst the top end of the tubular remains accessible for the quill of the top drive device. The rotatable head clamp assembly is provided with a thrust bearing adapted to support the load of the drilling tubulars string during a drilling process, when the quill of the top drive device is connected to the top end of the drilling string, e.g. by a threaded connection. The top drive device including the top drive motor, transmission, and quill, is vertically displaceable relative to the frame of the trolley by one or more vertical displacement actuators provided between the frame and the top drive device so that the top drive device is vertically mobile relative to the frame by said one or more vertical displacement actuators. This allows to perform controlled lowering and raising of the top drive device during make up or breaking of the threaded connection between the quill or rotary stem on the one hand and the tool joint or box member of the tubular suspended from the rotatable head clamp assembly on the other hand.

In the field, especially in the offshore drilling field, downtime due to equipment failure is considered a major issue. Whilst a drilling or other wellbore related operation involves the use of numerous pieces of equipment, studies seem to indicate that the top drive device is one of the major contributors to undesirable downtime.

Other developments in the field concentrate on enhanced maintenance schedules for equipment, including of the top drive, to prevent failures from occurring.

Notwithstanding the efforts made so far to reduce downtime, failures of top drive devices still occur at the expense of very costly downtime of the drilling installation.

OBJECT OF THE INVENTION

It is an object of the invention to provide an improved top drive system.

The present invention aims to propose measures that allow to reduce the downtime due to top drive failure and/or allow enhanced, e.g. more efficient, wellbore activities, e.g. exchanging one top drive device for another top drive device, efficient switching between drilling and tripping (out), efficient drilling with casing, etc.

SUMMARY OF THE INVENTION

The invention provides a top drive system.

The inventive top drive system comprises:

frame structure adapted to support the load of a drilling tubulars string that passes along a firing line to or into a wellbore, a top drive device comprising:

one or more top drive motors adapted to impart rotary torque to a drilling tubulars string, a transmission housing accommodating a transmission to which said one or more top drive motors are connected, e.g. each via a respective operable clutch, a floating quill system comprising a hollow vertical floating quill shaft that is vertically mobile relative to the transmission housing whilst in engagement with the transmission allowing the floating quill shaft to be driven by said one or more top drive motors, said floating quill system further comprising one or more floating quill shaft vertical displacement actuators configured to cause controlled vertical motion of the floating quill shaft, at least during make up and/or breaking of a threaded connection to the drill tubulars string, a thrust bearing housing arranged below the transmission housing and suspended from the frame structure, said thrust bearing housing being provided with a thrust bearing configured to support the load of a drilling tubulars string, a hollow vertical outer main shaft, suspended from the thrust bearing housing via said thrust bearing so as to be rotational relative to said thrust bearing housing, said outer main shaft having a portion that extends below said thrust bearing housing, a hollow vertical inner main shaft, arranged vertically mobile within the outer main shaft, wherein the inner main shaft is connected, e.g. releasably connected, to the floating quill shaft so as to move vertically along with the floating quill shaft and so as to rotate along with the floating quill shaft when driven by the one or more top drive motors, wherein the inner main shaft has a lower connector end that is configured to be connected to a drilling tubulars string via a threaded connection, so as to allow for transmission of the rotary torque from the one or more top drive motors via the transmission, the floating quill shaft, the inner main shaft, to the threadedly connected drilling tubular string, wherein the inner main shaft, on the one hand, and the outer main shaft, on the other hand, are provided with cooperating axial load support faces, said axial load support faces being engaged in a lowered position of the assembly of the floating quill shaft and the inner main shaft relative to the outer main shaft and said axial load support faces being disengaged in a raised position of said assembly of the floating quill shaft and the inner main shaft relative to the outer main shaft, wherein the outer main shaft, preferably at a lower end thereof, is provided with an elevator bails carrier that is configured to carry elevator bails.

An advantage of the inventive top drive system is the provision of effective and reliable load paths for vertical loads during drilling of a wellbore involving a drilling tubular string connected to a drive by the top drive and during tripping of the drilling tubular string.

During drilling of a wellbore wherein use is made of the inventive top drive system the drilling tubulars string is connected to the assembly of the floating quill shaft and the inner main shaft so that the one or more top drive motors impart rotary torque to the string. Herein the assembly of the floating quill shaft and the inner main shaft is in said lowered position, whereby the cooperating axial load support faces are engaged. A drilling operation load path is now established, wherein the load, e.g. the weight, of the drilling tubular string passes via the inner main shaft, the cooperating axial load support faces, the outer main shaft, the thrust bearing into the thrust bearing housing, and then via the first and second vertical frame members to the top frame member. This means that the load bypasses the transmission and the top drive motors.

During tripping of a drilling tubulars string, e.g. out of or into a wellbore, it is envisaged that use is made of an elevator that is suspended via elevator bails from the elevator bails carrier of the inventive top drive system. Herein the uppermost section of the drilling tubulars string is suspended, e.g. via the tool joint thereof, from the elevator. A tripping operation load path is now established, wherein the load, e.g. the weight, of the drilling tubular string passes via the elevator, the elevator bails, the elevator bails carrier, the outer main shaft, and the thrust bearing into the thrust bearing housing, and then via the first and second vertical frame members to the top frame member. It is envisaged that during tripping the inner main shaft is mostly not threadedly connected to the string, as there is commonly no reason to impart rotary torque during tripping. As in the drilling operation, the load bypasses the transmission and the top drive motors.

As explained above, the inventive top drive system establishes a drilling operation load path via the inner main shaft, the cooperating axial load support faces, the outer main shaft, the thrust bearing into the thrust bearing housing. The inventive top drive system establishes a distinct tripping operation load path via the elevator, the elevator bails, the elevator bails carrier, the outer main shaft, and the thrust bearing into the thrust bearing housing.

In practical embodiments the top drive system, including the thrust bearing thereof, is embodied to handle a vertical load of at least 500 tonnes, or even at least 1000 tonnes, or even at least 1500 tonnes exerted thereon by a drilling tubulars string whilst said string is rotated by the top drive device in a drilling operation and/or during tripping.

In embodiments, the frame structure comprises:

a top frame member configured to be suspended from a main hoisting device, a first vertical frame member and a second vertical frame member, each connected at an upper end thereof to said top frame member, said first and second vertical frame members depending from said top frame member spaced apart from one another and being adapted to support the load of a drilling tubulars string that passes along a firing line to or into a wellbore.

In an embodiment, the frame structure is movable up and down relative to a drilling tower by means of a rack-and-pinion device.

In an embodiment, the frame structure is movable up-and-down by means of a RamRig type hoisting device, wherein one or more vertically oriented hydraulic cylinders engage on one or more hoisting cables from which the frame structure is suspended.

In embodiments, the elevator bails carrier is rotationally mounted relative to the outer main shaft and a coupling mechanism is provided that allows to selective engage and disengage the elevator bails carrier from rotating together with the outer main shaft.

In embodiments, the elevator bails carrier is rotationally mounted on the outer main shaft and axial load support faces are present on the elevator bails carrier and the outer main shaft respectively. The coupling mechanism comprises a lifting arrangement acting on the elevator bails carrier that is configured to selective lift and lower the elevator bails carrier relative to the outer main shaft. In a lifted position of the elevator bails carrier these axial load support faces are disengaged from one another, thereby allowing for rotation of the elevator bails carrier relative to the outer main shaft as frictional forces are reduced or absent. In a lowered position these axial load support faces are engaged, resulting in the elevator bails carrier being rotationally secured to the outer main shaft, e.g. by friction between these engaged faces. In an embodiment the lifting arrangement comprises a spring arrangement that normally urges the elevator bails carrier into the lifted position thereof, so that these axial load support faces are disengaged, and that gives way as a vertical load to which the elevator bails carrier is subject exceeds a threshold vertical load so that then the load support faces are engaged.

In embodiments, the top drive system further comprises a slewable leg structure having a head and one or more vertical legs depending from said head. This leg structure extends from the thrust bearing housing downwards, e.g. with one or two legs parallel to the main shaft arrangement, with each leg being laterally spaced from the outer main shaft. For example, as preferred a pair of vertical legs is present in the slewable leg structure, diametrically opposite one another relative to the vertical axis of the main shaft arrangement. Between the head of the leg structure on the one hand and the thrust bearing housing on the other hand a slew bearing is arranged, that allows for the leg structure to be slewable about the vertical axis of the main shaft arrangement.

In an embodiment, a slew drive is provided between the slewable leg structure and the thrust bearing housing. For example, one or more slew drive motors are mounted on the thrust bearing housing and the head of the slewable leg structure is provided with a slew gear member extending about the vertical axis of the main shaft arrangement. The one or more slew drive motors driven one or more pinions that mesh with said slew gear member.

In an embodiment, the slewable leg structure is provided with said lifting arrangement that is configured to act on the elevator bails carrier and that is configured to selective lift and lower the elevator bails carrier relative to the outer main shaft. For example, the lifting arrangement comprises a lifting frame member that extends underneath the elevator bails carrier, which lifting frame member is vertically mobile secured to the one or more vertical legs of the slewable leg structure. For example, the lifting frame member is secured to each vertical leg by means of a spring arrangement that normally urges the lifting frame member, and thereby the elevator bails carrier, into a lifted position thereof. As explained this may cause that cooperating axial load support faces of the elevator bails carrier and the outer main shaft are disengaged when the vertical load on the elevator bails carrier is below a threshold value. When said vertical load is above said threshold value the spring arrangement gives way, e.g. springs being compressed or extended, so that then the load support faces are engaged. This arrangement effectively creates a third load path option of the inventive top drive system, namely in case the lifting arrangement mounted on the slewable leg structure causes disengagement of these axial load support faces of the elevator bails carrier and the outer main shaft. As explained, this can be done on the basis of the vertical load being below a threshold value, e.g. in practical embodiments at a relatively low vertical load on the carrier. In this third load path option the vertical load acting on the elevator bails carrier, e.g. caused by the elevator system being in use, passes via the lifted carrier, the lifting arrangement, the slewable leg structure, the slew bearing of said slewable leg structure, into the thrust bearing housing. So this load path, e.g. effective when a relatively low vertical load acts on the carrier, bypasses the outer main shaft and the thrust bearing. For example, the lifting arrangement lifts the carrier so as to disengages these axial load support surface at vertical loads below 50 tonnes, or in any event at loads below the rated capacity of the slew bearing that interconnects the leg structure and the thrust bearing housing. At higher loads, so e.g. at loads above 50 tonnes, these axial load support faces are engaged so that said load is primarily follows a path from the carrier, via these axial load support faces, to the outer main shaft, the thrust bearing, to the thrust bearing housing.

In embodiments, a slew drive mechanism is provided between the thrust bearing housing and the elevator bails carrier to cause controlled slew motion of the elevator bails carrier relative to the thrust bearing housing about the vertical axis of the main shaft arrangement.

Due to the outer main shaft being slewable about the vertical axis relative to the thrust bearing housing, the inventive top drive system allows to bring the elevator bails carrier in different angular position seen in a top view. This, for example, allows to effectively position this carrier in an operable angular position wherein, with the elevator suspended therefrom via the associated bails, the elevator system can be used. This carrier can also be brought, e.g. via a slew drive, into another, e.g. inactive, position, wherein the elevator bails can be tilted sideways into a retracted position away from the firing line, when no use is made of the elevator system.

In embodiments, it is envisaged that a valve arrangement is secured to the lower connector end of the inner main shaft, said valve arrangement comprising one or more valves that are configured to control fluid flow through the drilling tubular string. For example, an IBOP stack is provided, e.g. with dual IBOP valves, e.g. one automatic IBOP valve and one manually operable IBOP valve.

In embodiments, the top drive system is provided with a threaded saver sub that threadingly connects to the threaded tool joint of the uppermost tubular of the drilling tubulars string that is to be connected to the top drive system. In embodiments this saver sub is mounted at the lower end of the valve arrangement secured to the lower connector end of the inner main shaft.

In an embodiment, a wrench and/or clamp device, e.g. a backup clamp, is mounted on the slewable leg structure, e.g. the wrench and/or clamp device being telescopically movable in vertical direction relative the one or more fixed lengths legs of the slewable leg structure. This allows to position the wrench and/or clamp device at different heights, e.g. a height for use when threadingly connecting a threaded drilling tubular to the top drive system and another height, e.g. higher up, for use in making or breaking a connection between a valve arrangement that is secured to the connector end of the inner main shaft.

In an embodiment, the one or more vertical legs of the slewable leg structure are telescopic in vertical direction, e.g. a lower telescopic section of the one or more telescopic legs supporting the wrench and/or clamp device also allowing for use thereof at different heights.

In an embodiment, an elevator bails tilt mechanism is provided, which is configured to move the elevator bails between a vertical orientation to align the elevator with the firing and one or more tilted orientations, wherein the elevator is remote from the firing line. The elevator bails tilt mechanism may be connected between the elevator bails carrier and the elevator bails, but may also be arranged between the slewable leg structure and the elevator bails.

The inventive top drive system allows for make-up and break-up of a threaded connection to the drilling tubular string using the floating quill system, wherein the assembly of the quill shaft and the interconnected inner main shaft is vertically moved as required for the activity.

As preferred, in embodiments, the transmission and the one or more top drive motors are placed on top of the thrust bearing housing, so their weight is supported thereon. This allows, as preferred, to avoid a vertical load bearing connection between the assembly of the transmission housing and one or more top drive motors on the one hand and the frame of the top drive system on the other hand.

In embodiments, as preferred, the connection between the inner main shaft and the floating quill shaft is releasable, e.g. a threaded connection, e.g. a threaded connection combined with an anti-loosening locking device that prevents the threaded connection from become undone when unscrewing torque is put on the connection during an operation of the top drive system.

In embodiments, as preferred, the transmission housing is releasably mounted on top of the thrust bearing housing, e.g. allowing for removal of the transmission housing once the releasable connection between the floating quill shaft and the inner main shaft has been undone.

In embodiments, as preferred, the transmission housing is resiliently mounted on top of the thrust bearing housing, e.g. the resilient support allowing for the transmission to remain aligned with the assembly of the quill shaft and the inner main shaft, thereby avoiding undue stress and/or wear in the transmission.

In embodiments, the transmission comprises a main gear member having a vertical central splined bore through which the quill shaft extends, wherein a section of the quill shaft is splined, the splines of the gear member and the quill shaft meshing. Herein the one or more top drive motors drive the main gear member, e.g. each top drive motor having a vertical drive motor shaft with a pinion that meshes with the main gear member.

The thrust bearing housing may comprise a built-in lubricating system for at least the thrust bearing and/or a monitoring system for at least the thrust bearing, e.g. to monitor effective load and/or wear and/or temperature of the thrust bearing.

As preferred, the one or more top drive motors are electric motors having a stator housing and a rotor. As known in the art, in embodiments, at least one, preferably each, of the top drive motors may be provided with an operable clutch device configured to selectively connect and disconnect upon command the rotor of the motor relative to the transmission.

In embodiment, the top drive device has four top drive motors above the transmission housing, wherein a first pair of motors is arranged, when seen in top view, in front of a second pair of motors.

In an embodiment, the frame structure has a top frame member, e.g. extending in a transverse direction, provided with multiple cable sheaves and/or with multiple cable sheave connectors that are each connectable to a cable sheave allowing to suspend the frame from one or more winch driven cables of a main hoisting device.

In an embodiment, the top frame member forms part of a frame structure of a trolley that is vertically mobile along one or more vertical trolley rails, e.g. said one or more vertical trolley rails being mounted on a drilling tower.

In an embodiment, the trolley has a rigid frame structure formed by one or more rear frame members, one or more forward cantilevered frame members extending forward from a top end of said one or more rear frame members, and by a transverse horizontal top frame member supported by said one or more forward cantilevered frame members at a distance forward of said one or more rear frame members. Herein the first and second vertical frame members are suspended from said transverse horizontal top frame member, said first and second link members preferably being suspended in a transverse plane that encompasses the firing line. A thrust bearing housing is connected, preferably releasably, to lower ends of the first and second vertical frame members.

In an embodiment, first and second vertical frame members of the frame structure are embodied as left-hand and right-hand members, with the thrust bearing housing being connected, e.g. with a pin-in-hole-connection, to lower ends of said members.

In embodiments, a reaction torque structure is arranged between the frame structure and the transmission housing, e.g. when the transmission housing is mounted on the thrust bearing housing via one or more resilient members so as to avoid said resilient members being loaded by said reaction torque. For example, the reaction torque structure extends between the transmission housing and a rear frame member of a trolley.

In embodiment, a swivel fluid connector is provided at the top end of the floating quill shaft, allowing for transfer of fluid, e.g. drilling mud, into the hollow quill shaft, which fluid then travels through the hollow inner main shaft into the hollow tubular drilling string during a wellbore related operation, e.g. during drilling. A flexible fluid transfer hose or the like may connect to the swivel in case the swivel is configured to move up and down with the quill shaft.

The present invention also relates to a top drive device as disclosed herein.

The present invention also relates to a top drive device configured for use in drilling of a wellbore using a drilling tubular string, the top drive device comprising:

- one or more top drive motors adapted to impart rotary torque to a drilling tubulars string,
- a transmission housing accommodating a transmission to which said one or more top drive motors are connected, e.g. each via a respective operable clutch,
- a floating quill system comprising a hollow vertical floating quill shaft that is vertically mobile relative to the transmission housing whilst in engagement with the transmission allowing the floating quill shaft to be driven by said one or more top drive motors, said floating quill system further comprising one or more floating quill shaft vertical displacement actuators configured to cause controlled vertical motion of the floating quill shaft, at least during make up and/or breaking of a threaded connection to the drill tubulars string,
- a thrust bearing housing arranged below the transmission housing and configured to be suspended from a frame structure, e.g. from a frame structure embodied as a vertical mobile trolley of a drilling installation, e.g. via first and second vertical frame members from a top frame member of such a frame structure, said thrust bearing housing being provided with a thrust bearing configured to support the load of a drilling tubulars string, a hollow vertical outer main shaft, suspended from the thrust bearing housing via said thrust bearing so as to be rotational relative to said thrust bearing housing, said outer main shaft having a portion that extends below said thrust bearing housing, a hollow vertical inner main shaft, arranged vertically mobile within the outer main shaft, wherein the inner main shaft is connected, e.g. releasably connected, to the floating quill shaft so as to move vertically along with the floating quill shaft and so as to rotate along with the floating quill shaft when driven by the one or more top drive motors, wherein the inner main shaft has a lower connector end that is configured to be connected to a drilling tubulars string via a threaded connection, so as to allow for transmission of the rotary torque from the one or more top drive motors via the transmission, the floating quill shaft, the inner main shaft, to the threadedly connected drilling tubular string, wherein the inner main shaft, on the one hand, and the outer main shaft, on the other hand, are provided with cooperating axial load support faces, said axial load support faces being engaged in a lowered position of the assembly of the floating quill shaft and the inner main shaft relative to the outer main shaft and said axial load support faces being disengaged in a raised position of said assembly of the floating quill shaft and the inner main shaft relative to the outer main shaft, wherein the outer main shaft, preferably at a lower end thereof, is provided with an elevator bails carrier that is configured to carry elevator bails.

It will be appreciated that in this top drive device may have one or more of the features discussed herein with reference to the top drive system.

The present invention also relates to a wellbore drilling installation, wherein the installation comprises:

a drilling tower, a drill floor having a well center through which a drilling tubulars string can pass along a firing line, at least one vertical trolley rail, e.g. mounted on said drilling tower, a trolley, said trolley being guided along at least one vertical trolley rail, a main hoisting device adapted to lift and lower said trolley along said at least one vertical trolley rail, said main hoisting device e.g. comprising one or more winch driven cables from which said trolley is suspended, wherein the trolley has a frame structure adapted to support the load of a drilling tubulars string that passes along a firing line to or into a wellbore, a top drive device comprising:

one or more top drive motors adapted to impart rotary torque to a drilling tubulars string, a transmission housing accommodating a transmission to which said one or more top drive motors are connected, e.g. each via a respective operable clutch, a floating quill system comprising a hollow vertical floating quill shaft that is vertically mobile relative to the transmission housing whilst in engagement with the transmission allowing the floating quill shaft to be driven by said one or more top drive motors, said floating quill system further comprising one or more floating quill shaft vertical displacement actuators configured to cause controlled vertical motion of the floating quill shaft, at least during make up and/or breaking of a threaded connection to the drill tubulars string, a thrust bearing housing arranged below the transmission housing and suspended from the frame structure, said thrust bearing housing being provided with a thrust bearing configured to support the load of a drilling tubulars string, a hollow vertical outer main shaft, suspended from the thrust bearing housing via said thrust bearing so as to be rotational relative to said thrust bearing housing, said outer main shaft having a portion that extends below said thrust bearing housing, a hollow vertical inner main shaft, arranged vertically mobile within the outer main shaft, wherein the inner main shaft is connected, e.g. releasably connected, to the floating quill shaft so as to move vertically along with the floating quill shaft and so as to rotate along with the floating quill shaft when driven by the one or more top drive motors, wherein the inner main shaft has a lower connector end that is configured to be connected to a drilling tubulars string via a threaded connection, so as to allow for transmission of the rotary torque from the one or more top drive motors via the transmission, the floating quill shaft, the inner main shaft, to the threadedly connected drilling tubular string, wherein the inner main shaft, on the one hand, and the outer main shaft, on the other hand, are provided with cooperating axial load support faces, said axial load support faces being engaged in a lowered position of the assembly of the floating quill shaft and the inner main shaft relative to the outer main shaft and said axial load support faces being disengaged in a raised position of said assembly of the floating quill shaft and the inner main shaft relative to the outer main shaft, wherein the outer main shaft, preferably at a lower end thereof, is provided with an elevator bails carrier that is configured to carry elevator bails.

It will be appreciated that in this drilling installation the top drive device and/or the frame structure may have one or more of the features discussed herein with reference to the top drive system.

The present invention also relates to an offshore drilling vessel, e.g. a monohull vessel or a semi-submersible vessel, provided with the wellbore drilling installation and/or the top drive system, and/or top drive device as discussed herein.

The present invention also relates to a method for drilling a wellbore, e.g. a subsea wellbore, and other wellbore related activities involving a drilling tubulars string wherein use is made of a top drive system, top drive device, or a drilling installation as disclosed herein.

The present invention also relates to a method for drilling a wellbore, e.g. a subsea wellbore, wherein use is made of the inventive top drive system and wherein a drilling tubulars string is connected to the assembly of the floating quill shaft and the inner main shaft so that the one or more top drive motors impart rotary torque to the string. Herein the assembly of the floating quill shaft and the inner main shaft is in a lowered position, whereby the cooperating axial load support faces are engaged. A drilling operation load path is now established, wherein the load, e.g. the weight, of the drilling tubular string passes via the inner main shaft, the cooperating axial load support faces, the outer main shaft, and the thrust bearing into the thrust bearing housing, and then to the frame structure, e.g. via first and second vertical frame members to a top frame member.

The present invention also relates to a method for tripping a drilling tubulars string, e.g. into or out of a wellbore, e.g. a subsea wellbore, wherein use is made of the inventive top drive system and wherein during tripping of a drilling tubulars string use is made of an elevator that is suspended via elevator bails from the elevator bails carrier of the inventive top drive system. Herein an uppermost section of the drilling tubulars string is suspended, e.g. via the tool joint thereof, from the elevator. A tripping operation load path is now established, wherein the load, e.g. the weight, of the drilling tubular string passes via the elevator, the elevator bails, the elevator bails carrier, the outer main shaft, and the thrust bearing into the thrust bearing housing, and then to the frame structure, e.g. via first and second vertical frame members to a top frame member. It is envisaged that during tripping the inner main shaft is mostly not threadedly connected to the string, as there is commonly no reason to impart rotary torque during tripping.

The present invention also relates to a method for performing a wellbore related activity, e.g. tripping of a drilling tubulars string, wherein use is made of a made of the inventive top drive system of an elevator that is suspended via elevator bails from the elevator bails carrier of the inventive top drive system. Herein the top drive system is further provided with the slewable leg structure and lifting arrangement for the elevator bails carrier as discussed herein, wherein the lifting arrangement is configured to act on the elevator bails carrier and to selective lift and lower the elevator bails carrier relative to the outer main shaft so as to selectively disengage and engage the carrier and the outer main shaft with regard to their relative rotation.

In an embodiment, a lifting frame member is secured to the slewable leg structure, e.g. to each vertical leg thereof, by means of a spring arrangement that normally urges the lifting frame member, and thereby the elevator bails carrier, into a lifted position thereof. Hereby the cooperating axial load support faces of the elevator bails carrier and the outer main shaft are disengaged when the vertical load on the elevator bails carrier is below a threshold value. When said vertical load is above said threshold value the spring arrangement gives way, e.g. springs being compressed or extended, so that then the load support faces are engaged. This arrangement effectively creates a third load path option of the inventive top drive system, namely in case the lifting arrangement mounted on the slewable leg structure causes disengagement of these axial load support faces of the elevator bails carrier and the outer main shaft. As explained, this can be done on the basis of the vertical load being below a threshold value, e.g. in practical embodiments at a relatively low vertical load on the carrier. In this third load path option the vertical load acting on the elevator bails carrier, e.g. caused by the elevator system being in use, passes via the lifted carrier, the lifting arrangement, the slewable leg structure, the slew bearing of said slewable leg structure, into the thrust bearing housing. So this load path, e.g. effective when a relatively low vertical load acts on the carrier, bypasses the outer main shaft and the thrust bearing.

A second aspect of the invention relates to the use of so-called wired drilling tubulars in the drill string. Reference is made in this regard to WO2010/120507. Here the drilling tubulars string comprising a plurality of wired drilling tubulars, e.g. drill pipes. Herein each wired drilling tubular is provided at both ends thereof with one or more induction coils and one or more wires extend along the length of the tubular between the coils at said opposite ends.

In WO2010/120507 it is shown that, e.g. for use during tripping or another activity wherein the top drive need not be used to drive the drilling tubulars string, an uppermost tubular of the string of wired tubulars is supported by the elevator of an elevator system. On an elevator bails of the elevator system an inductive coupler is mounted in a mobile manner. The coupler is configured for communication to a surface system and via the wired drilling tubulars string to a downhole system to allow for communication between the surface system and the downhole system. The coupler is an inductive coupler configured to inductively couple to an induction coil or coils provided at the upper end of the uppermost tubular. A frame mounted to be bail supports the coupler, and an actuator is provided to move the frame with the coupler thereon between an engaged position operatively connected to the uppermost drilling tubular and a disengaged position a distance from the uppermost drilling tubular whereby the coupler selectively establishes a communication link between the surface system and the downhole system.

The second aspect of the invention aims to provide an improved arrangement of the inductive coupler.

This is achieved in that the inductive coupler is mounted at the lower end of the floating quill shaft, or, when present, at the lower end of the inner main shaft as described herein. So the functionality of the floating quill is used to move the inductive coupler into engagement with the one or more coils at the upper end of the uppermost drilling tubular retained by the elevator. This allows to dispense with the frame and actuator as proposed in WO2010/120507.

It will be appreciated that the second aspect of the invention can be readily integrated with the inventive top drive system discussed herein. The second aspect can also be integrated in any top drive device having a floating quill.

For example, the second aspect relates to a method for tripping a wired drilling tubulars string, wherein use is made of a top drive device comprising:

- one or more top drive motors adapted to impart rotary torque to a drilling tubulars string,
- a transmission housing accommodating a transmission to which said one or more top drive motors are connected, e.g. each via a respective operable clutch,
- a floating quill system comprising a hollow vertical floating quill shaft that is vertically mobile relative to the transmission housing whilst in engagement with the transmission allowing the floating quill shaft to be driven by said one or more top drive motors, said floating quill system further comprising one or more floating quill shaft vertical displacement actuators configured to cause controlled vertical motion of the floating quill shaft, at least during make up and/or breaking of a threaded connection to the drill tubulars string,
- an elevator system comprising an elevator, wherein during tripping a tripping operation inductive coupler is fitted to the floating quill shaft, said coupler having a lower end that is not threaded, and is moved into and out of engagement with a coil of an uppermost drilling tubular retained by the elevator system without performing a screw motion.

The second aspect of the invention also relates to a top drive device for use with a wired drilling tubulars string, said top drive device comprising:

- one or more top drive motors adapted to impart rotary torque to a drilling tubulars string,
- a transmission housing accommodating a transmission to which said one or more top drive motors are connected, e.g. each via a respective operable clutch, a floating quill system comprising a hollow vertical floating quill shaft that is vertically mobile relative to the transmission housing whilst in engagement with the transmission allowing the floating quill shaft to be driven by said one or more top drive motors, said floating quill system further comprising one or more floating quill shaft vertical displacement actuators configured to cause controlled vertical motion of the floating quill shaft, at least during make up and/or breaking of a threaded connection to the drill tubulars string, an elevator system comprising an elevator, wherein a tripping operation inductive coupler is fitted to the floating quill shaft, said coupler having a lower end that is not threaded and is insertable into a box portion of a drilling tubular held by the elevator in absence of a screw motion to establish communication.

The second aspect of the invention also relates to a tripping operation inductive coupler as described herein.

The invention will be discussed below with reference to the drawings.

DETAILED DESCRIPTION OF EMBODIMENTS

The invention will now be discussed with reference to the figures.

Figure 1:
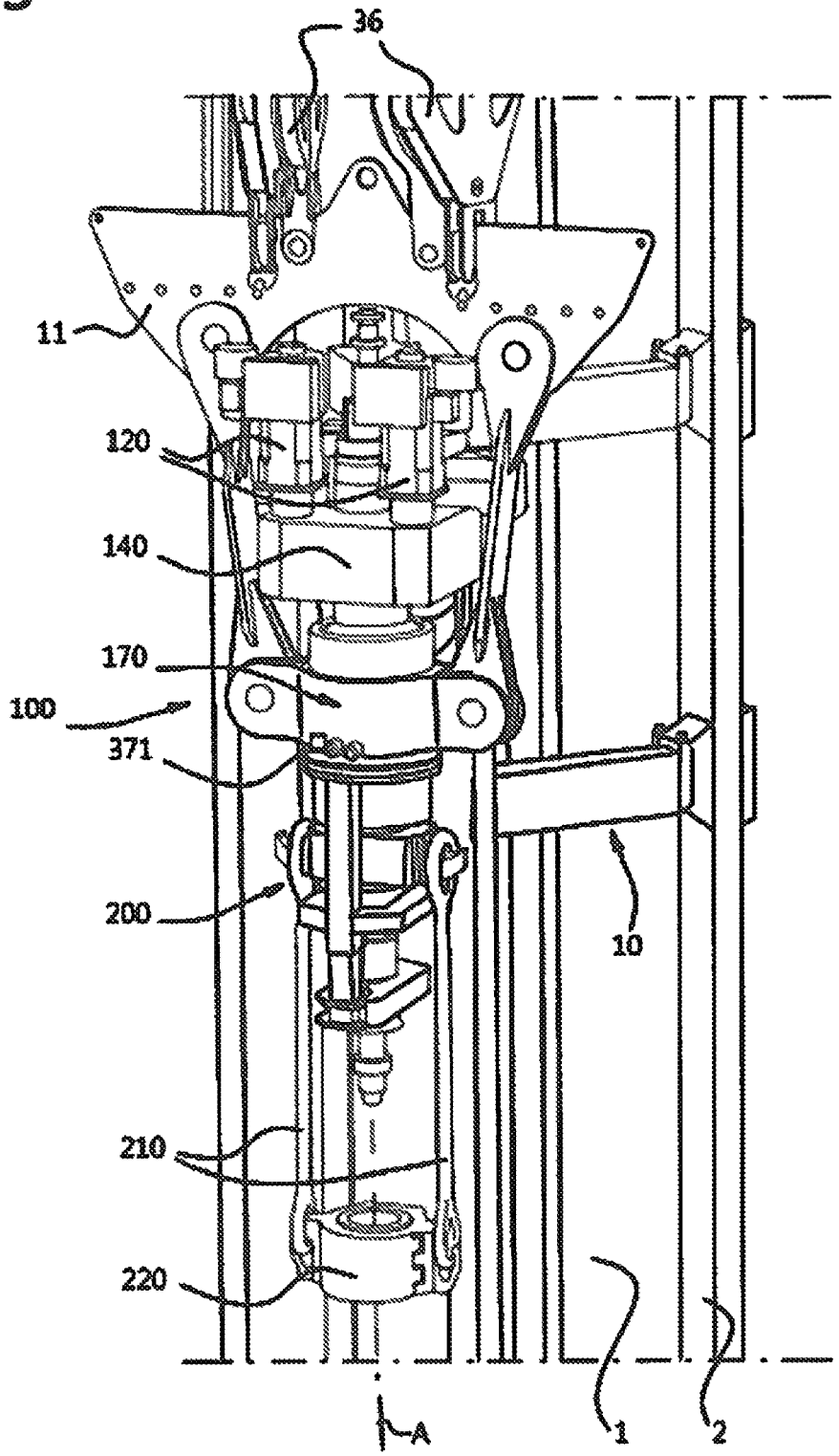
FIG. 1 shows a perspective view on a section of a drilling tower provided with an embodiment of a top drive system according to the invention.

FIG. 1 illustrates a part of a wellbore drilling installation configured for drilling a wellbore and/or other wellbore related activities.

FIG. 1 shows a part of the drilling tower 1, e.g. the tower 1 being mounted on an offshore drilling vessel. The wellbore drilling installation may further comprises a drill floor having a well center through which a drilling tubulars string can pass along a firing line into the wellbore.

The installation further comprises at least one vertical trolley rail 2, here two parallel trolley rails 2 mounted on the tower 1.

A trolley 10 is provided, which trolley 10 is guided along the at least one vertical trolley rail 2.

The installation further comprises a main hoisting device, here comprising one or more winch driven cables 30 from which the trolley 10 is suspended.

In more detail the main hoisting device here comprises one or more winches (not shown here), for example active heave compensated winches, that drive one or more cables 30. The one or more cables 30 extend over a crown block assembly 32, with crown block sheaves 33, and in a multiple fall arrangement between said crown block assembly and a travelling block assembly 35 with travelling block sheaves 36. As known in the art, one or more of the travelling block sheaves 36 may be embodied to be selectively coupled to the trolley or in a non-active position to the crown block assembly.

The trolley 10 has a frame structure comprising:

a top frame member 11 that is configured to be suspended from the main hoisting device, here from the travelling block sheaves 36, a first vertical frame member 12 and a second vertical frame member 13, each connected at an upper end thereof to the top frame member 11, said first and second vertical frame members 12, 13 depending from the top frame member spaced apart from one another and being adapted to support the load of a drilling tubulars string that passes along a firing line A to or into a wellbore.

In more detail the trolley has a frame structure formed by one or more rear frame members 14, here one rear frame member acting as a spine of the frame. The structure furthermore has one or more forward cantilevered frame members 15 extending forward from a top end of said one or more rear frame members 14. The top frame member 11 is embodied as a transverse horizontal top frame member supported by said one or more forward cantilevered frame members 15 at a distance forward of said one or more rear frame members 14.

The first and second frame members 12, 13 are suspended in a transverse plane that encompasses the firing line.

A thrust bearing housing is connected, preferably releasably, to lower ends of the first and second vertical frame members 12, 13.

The installation further comprises a top drive device 100.

The top drive device 100 comprises one or more, here four, top drive motors 120 that are adapted to impart rotary torque to a drilling tubulars string.

The top drive device 100 comprises a transmission housing 140 accommodating a transmission, here a gear transmission, to which said one or more top drive motors 120 are connected.

It is illustrated that the one or more top drive motors are electric motors having a stator housing and a rotor. As shown here, each top drive motor 120 has a vertical drive motor shaft connected to the rotor of the motor.

Preferably, at least one, preferably each, of the top drive motors 120 is provided with an operable clutch device configured to selectively connect and disconnect upon command the rotor of the motor relative to the transmission.

The top drive system further comprises a floating quill system which comprises a hollow vertical floating quill shaft 150 that is vertically mobile relative to the transmission housing 130 whilst in engagement with the transmission allowing the floating quill shaft 150 to be driven by said one or more top drive motors 120.

The floating quill system further comprises one or more floating quill shaft vertical displacement actuators, here two actuators 160 at diametrically opposed location relative to a top portion of the shaft 150 and connected to said shaft via a yoke 161. The actuators 160, e.g. hydraulic jacks, spindles, or the like, are configured to cause controlled vertical motion of the floating quill shaft 150, at least during make up and/or breaking of a threaded connection to the drill tubulars string.

The thrust bearing housing 170 is arranged below the transmission housing 140 and is suspended via the first and second vertical frame members 12, 13 from the top frame member 14 of the trolley 10.

The thrust bearing housing is provided with a thrust bearing 175 that is configured to support the load of a drilling tubulars string, e.g. a load of at least 500 tonnes.

The figures illustrate the provision in the top drive system of a hollow vertical outer main shaft 180 that is suspended from the thrust bearing housing 170 via the thrust bearing 175 so as to be rotational relative to the d thrust bearing housing 170. The outer main shaft 180 has a portion that extends below the thrust bearing housing 170.

The figures illustrate the provision in the top drive system of a hollow vertical inner main shaft 190 that is arranged vertically mobile within the outer main shaft 180.

The inner main shaft 190 is connected, here releasably connected via a threaded connection, to the floating quill shaft 150 so as to move vertically along with the floating quill shaft 150 and so as to rotate along with the floating quill shaft 150 when driven by the one or more top drive motors 120.

The inner main shaft has a passageway for drilling fluid that forms an extension of a passageway in the quill shaft 150.

The inner main shaft 190 has a lower connector end 192 that is configured to be connected to a drilling tubulars string via a threaded connection, so as to allow for transmission of the rotary torque from the one or more top drive motors 120 via the transmission 130, the floating quill shaft 150, the inner main shaft 190, to the threadedly connected drilling tubular string, e.g. for wellbore drilling.

The inner main shaft 190, preferably, has a vertical load handling capacity of at least 500 tonnes.

The inner main shaft 190, on the one hand, and the outer main shaft 180, on the other hand, are provided with cooperating axial load support faces 194, 184, e.g. formed by suitably shaped faces of the shafts 190, 180. Preferably, said faces 194, 184 are located in proximity of the thrust bearing 175 when engaged.

Figure 8:
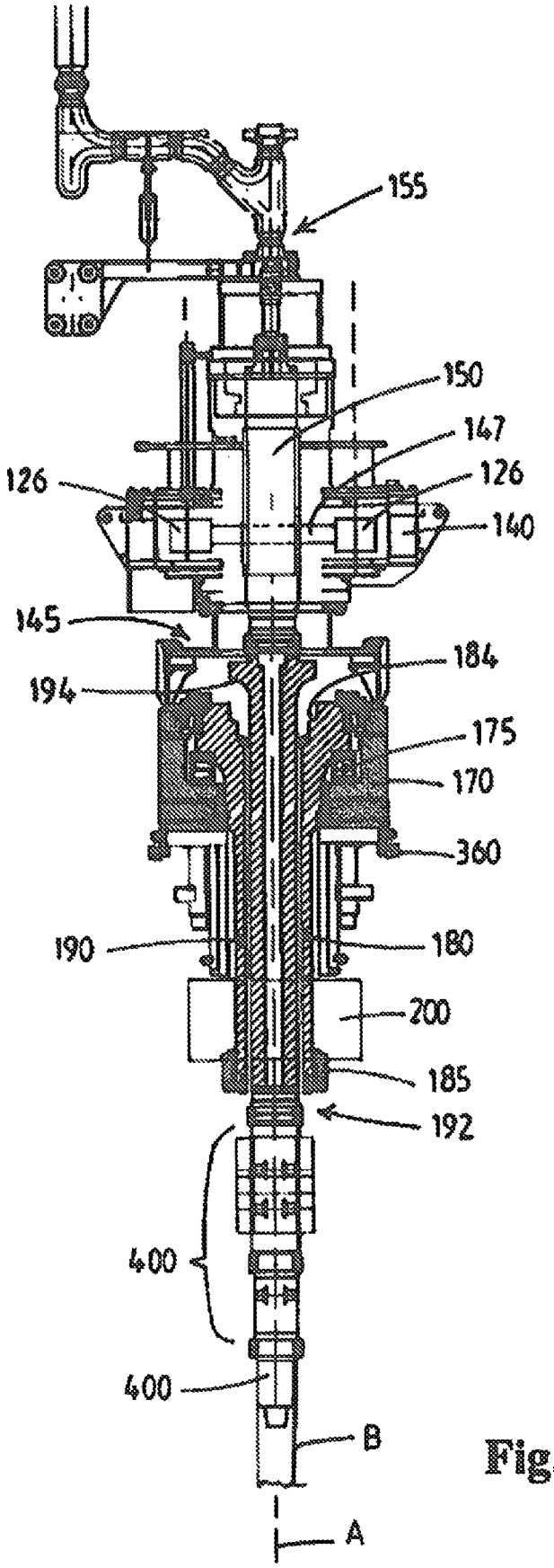
FIG. 8 illustrates, partly in vertical cross-section, main components of the top drive system of FIG. 2, wherein the inner main shaft is in its raised position.
Figure 9:
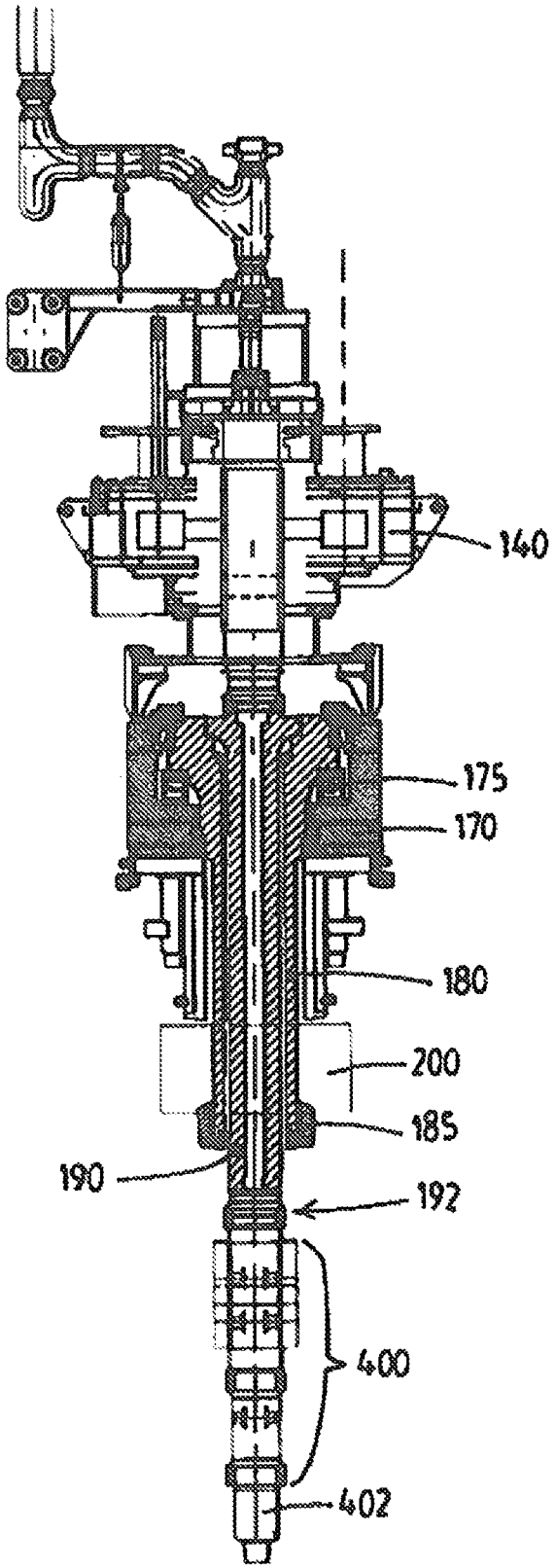
FIG. 9 illustrates the main components of FIG. 8, wherein the inner main shaft is in its lowered position.

These axial load support faces 194, 184 are engaged with one another in a lowered position of the assembly of the floating quill shaft 150 (see FIG. 9) and the inner main shaft 190 relative to the outer main shaft 180. These axial load support faces 194, 184 are disengaged in a raised position (see FIG. 8), caused by actuators 160, of said assembly of the floating quill shaft 150 and the inner main shaft 190 relative to the outer main shaft 180.

The outer main shaft 180, here at a lower end thereof, is provided with an elevator bails carrier 200 that is configured to carry a pair of elevator bails 210.

As common in the art, the elevator bails 210 have their upper ends releasably mated with the carrier 200. At their lower the elevator bails 210 carry an elevator 220.

For example, as here, the bails 210 have an eye opening at both of their upper and lower ends. The carrier 200 may have opposed ears, wherein each bail 210 is placed with its eye part over an ear, e.g. as described in U.S. Pat. No. 7,735,565.

The elevator bails carrier 200 is rotationally mounted relative to the outer main shaft 180, preferably to the lower portion thereof below the transmission housing.

It will be appreciated that the bails 210 may also carry another component than an elevator 220 when desired.

A coupling mechanism is provided that allows to selective engage and disengage the elevator bails carrier 200 from rotating together with the outer main shaft 180.

Figure 12:
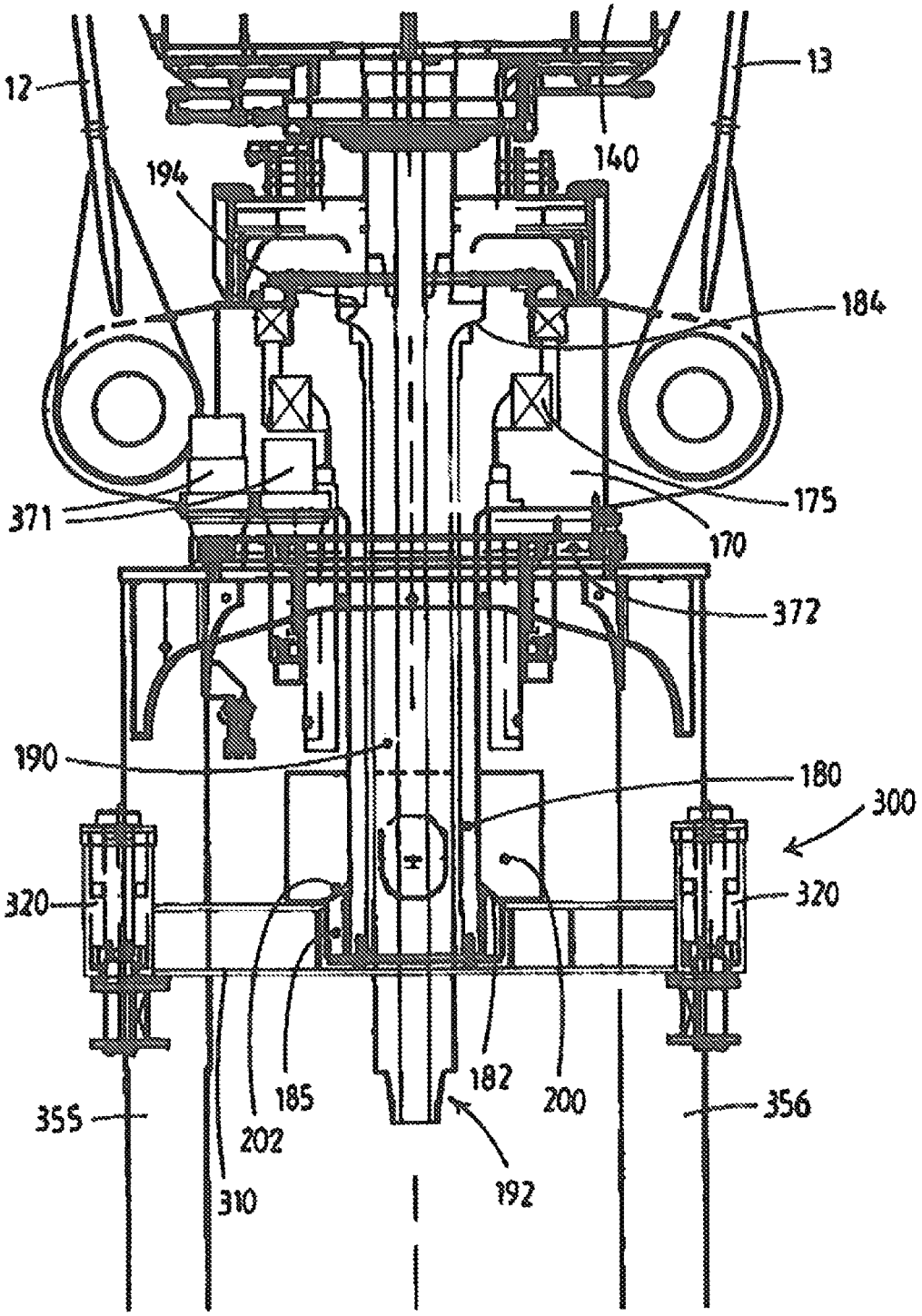
FIG. 12 shows partly in vertical cross-section a portion of the top drive system of FIG. 2.

Axial load support faces 202 and 182 are present on the elevator bails carrier 200 and the outer main shaft 180, here at the lower end thereof, respectively. As preferred these as annular faces 202, 182, preferably conical. For example, a ring member 185 having said face 182 is secured to the lower end of the shaft 180 (see e.g. FIG. 12).

The coupling mechanism effective between elevator bails carrier 200 and the main outer shaft 180 here comprises a lifting arrangement 300 acting on the elevator bails carrier 200, which lifting arrangement is configured to selective lift and lower the elevator bails carrier 200 relative to the outer main shaft 180. This will be discussed in more detail below.

It is illustrated that the transmission housing 140 and the one or more top drive motors 120 are placed on top of the thrust bearing housing 170.

The transmission housing 140 is releasably mounted, e.g. by bolts, on top of the thrust bearing housing 170, e.g. allowing for removal of the transmission housing once the releasable connection between the floating quill shaft 150 and the inner main shaft 190 has been undone.

It is illustrated that the transmission housing 140 is resiliently mounted on top of the thrust bearing housing 170, e.g. the resilient support 145 allowing for the transmission to remain aligned with the assembly of the quill shaft 150 and the inner main shaft 190.

A reaction torque structure 270 is arranged between the frame structure of the trolley, here rear frame member 14, and the transmission housing 140.

It is illustrated that the transmission comprises a main gear member 147 having a vertical central splined bore through which the quill shaft 150 extends, wherein a section of the quill shaft is splined, the splines of the gear member and the quill shaft meshing.

The one or more top drive motors 120 drive the main gear member 147, e.g. each top drive motor having a vertical drive motor shaft with a pinion 126 that meshes with the main gear member.

The figures further illustrate that the top drive system comprises a slewable leg structure 350 having a head 351 and one or more vertical legs 355, 356 depending from said head.

The leg structure 350 extends from the thrust bearing housing 170 downwards, here with two legs 355, 356 parallel to the main shaft arrangement, with each leg being laterally spaced from the outer main shaft 180.

Between the head 351 of the leg structure 350 on the one hand and the thrust bearing housing 170 on the other hand a slew bearing 360 is arranged that allows for the leg structure 350 to be slewable about the vertical axis of the main shaft arrangement of the top drive device.

A slew drive 370 is provided between the slewable leg structure 350 and the thrust bearing housing 170. As shown here one or more slew drive motors 371 are mounted on the thrust bearing housing 170 and the head of the slewable leg structure is provided with a slew gear member 372 extending about the vertical axis of the main shaft arrangement.

The slewable leg structure 350 is provided with the mentioned lifting arrangement 300.

The lifting arrangement comprises a lifting frame member 310 that extends underneath the elevator bails carrier 200. This lifting frame member 310 is vertically mobile secured to the one or more vertical legs of the slewable leg structure 350.

It is schematically illustrated in FIGS. 14-17 that the lifting frame member 310 is secured to the slewable leg structure 350 by means of a spring arrangement 320 that normally urges the lifting frame member 310, and thereby the elevator bails carrier 200, into a lifted position thereof wherein the faces 204, 184 are disengaged.

A valve arrangement 400 is secured to the lower connector end of the inner main shaft 190. This valve arrangement comprises one or more valves, e.g. a dual IBOP, that are configured to control fluid flow through the drilling tubular string. As known in the art, the one or more valves may the threaded to each other and to the lower end of the inner shaft, with a saver sub 402 being threaded to the lower end of the valve arrangement 400 for threaded connection to an uppermost section of a drilling tubulars string.

It is illustrated that a wrench and/or clamp device, e.g. a backup clamp 420, is mounted on the slewable leg structure 350. It is shown that the wrench and/or clamp device 420 is telescopically movable in vertical direction relative the one or more fixed lengths legs of the slewable leg structure 350. An vertical motion actuator 430 may be provided to move the device 420 up and down relative to the leg structure (illustrated in FIG. 13).

Figure 2:
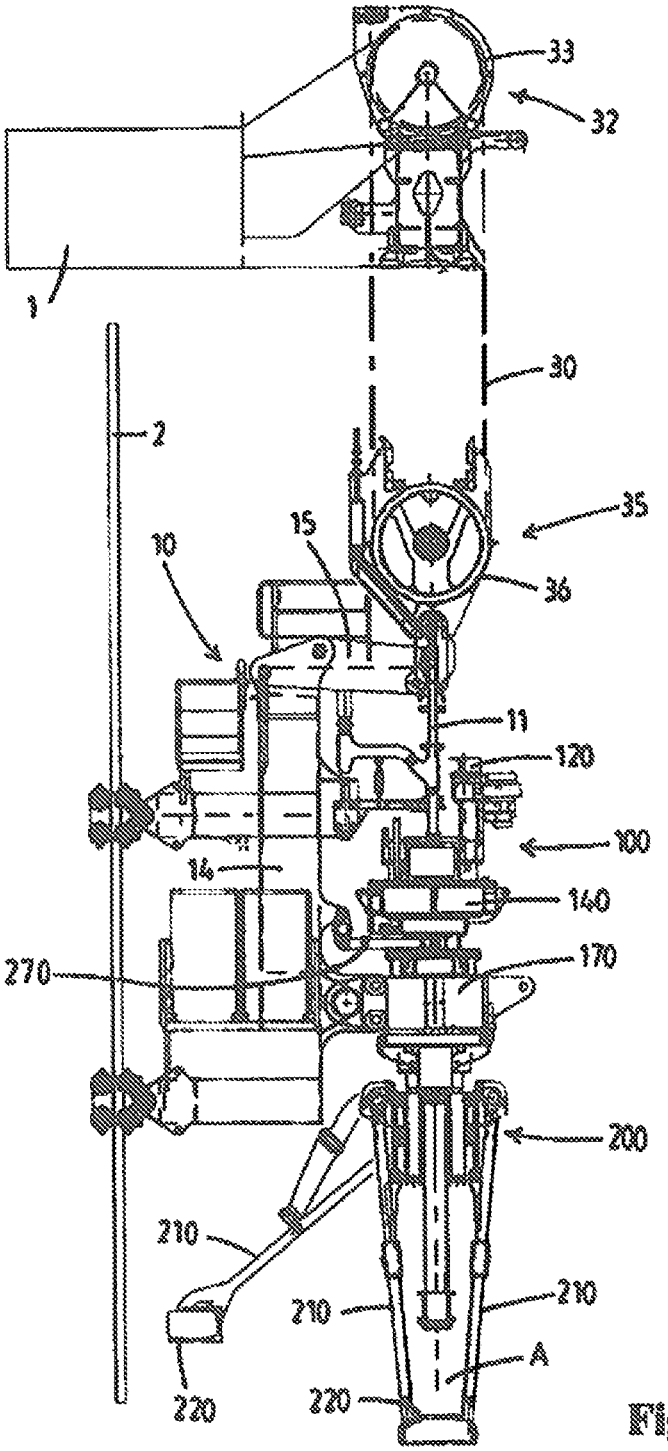
FIG. 2 shows in side view an embodiment of a top drive system according to the invention, along with a trolley rails and a crown block of a drilling tower.
Figure 3:
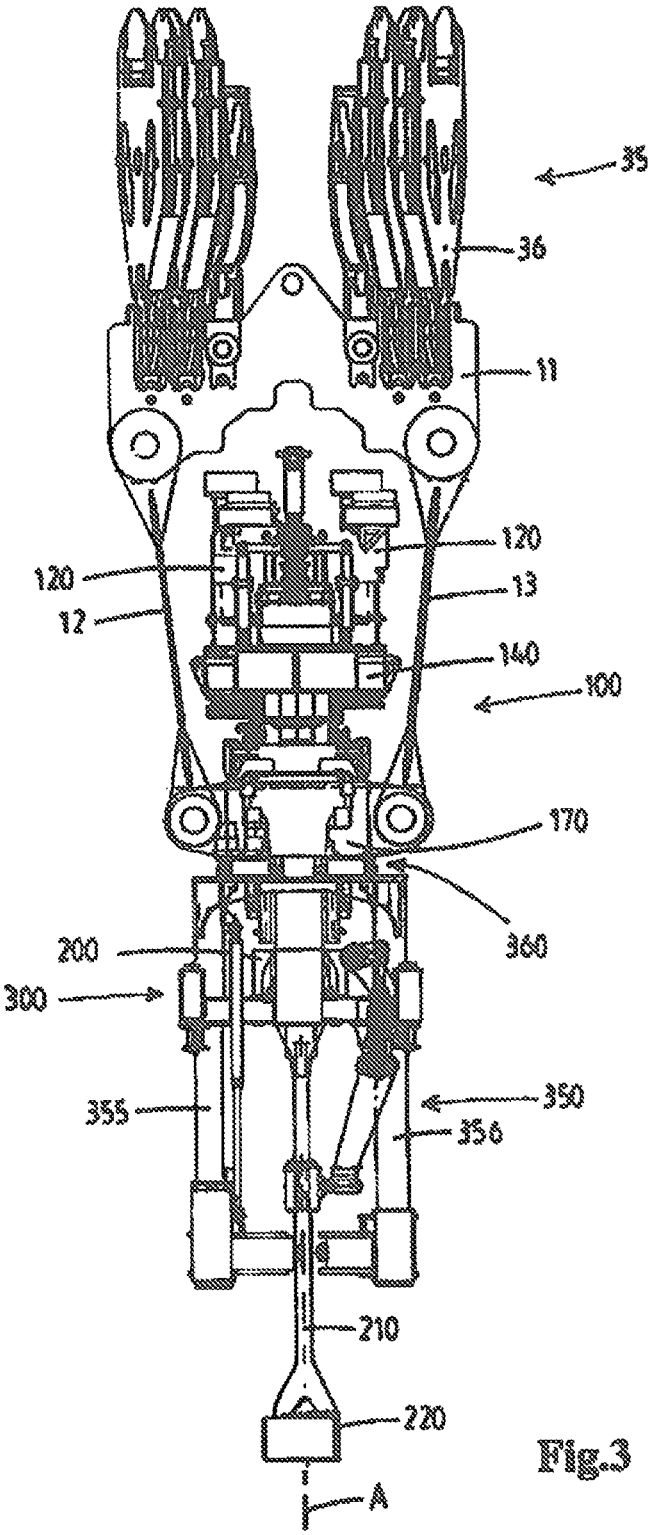
FIG. 3 shows the top drive system of FIG. 2 in front view.
Figure 4:
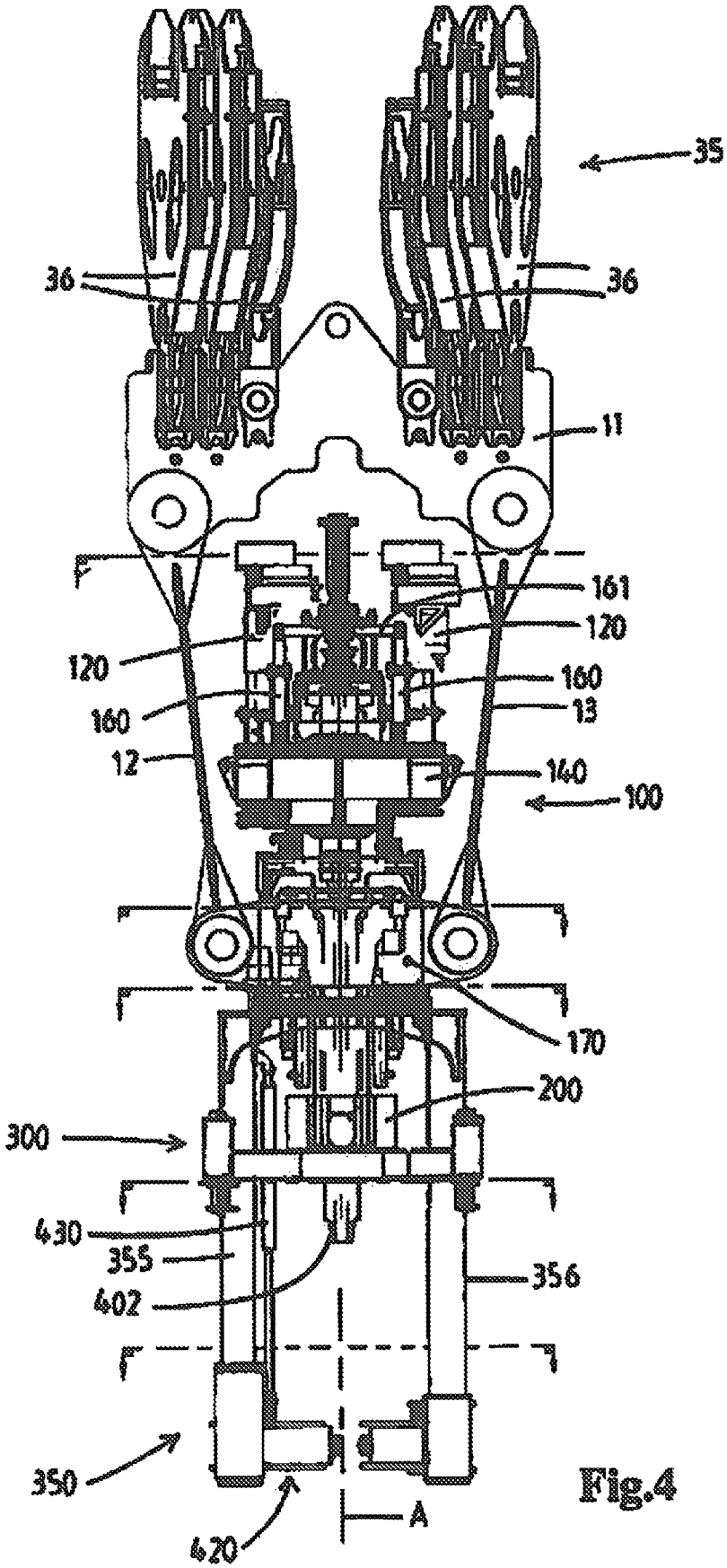
FIG. 4 shows the view of FIG. 3 with the elevator system removed for clarity.
Figure 5:
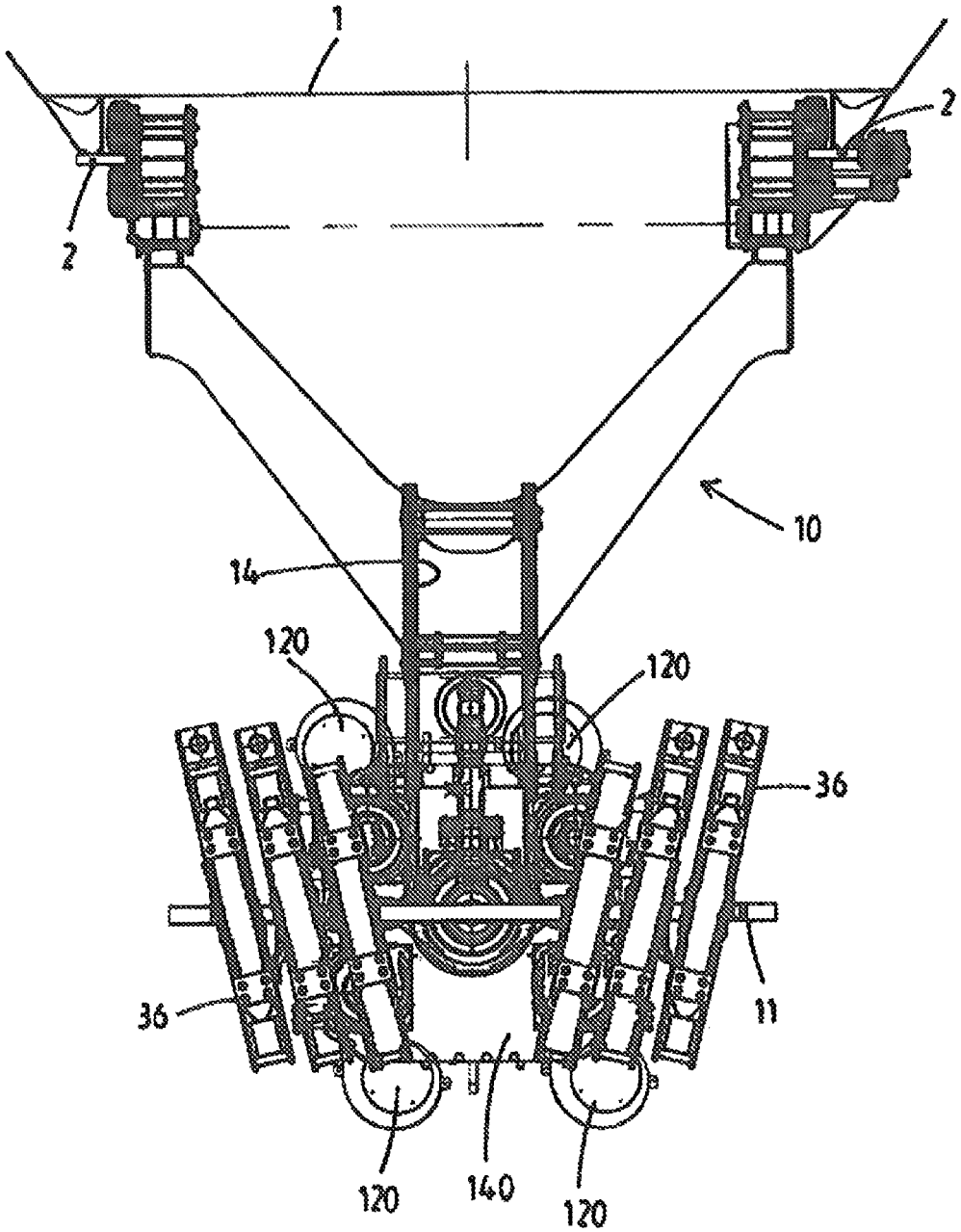
FIG. 5 shows a top view of the top drive system of FIG. 2.
Figure 6:
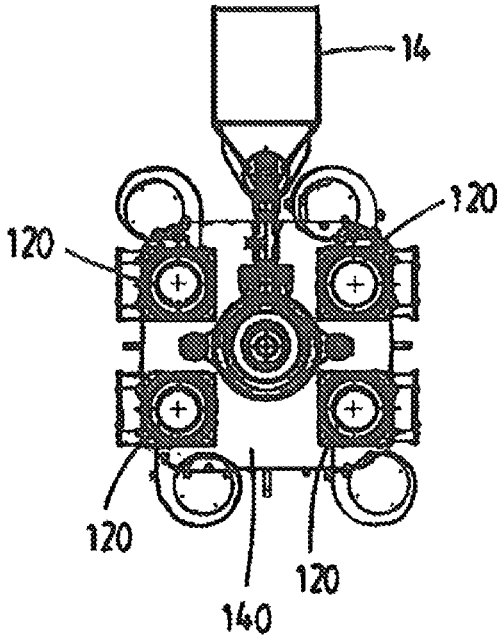
FIG. 6 shows a horizontal section of the top drive system of FIG. 2.
Figure 7:
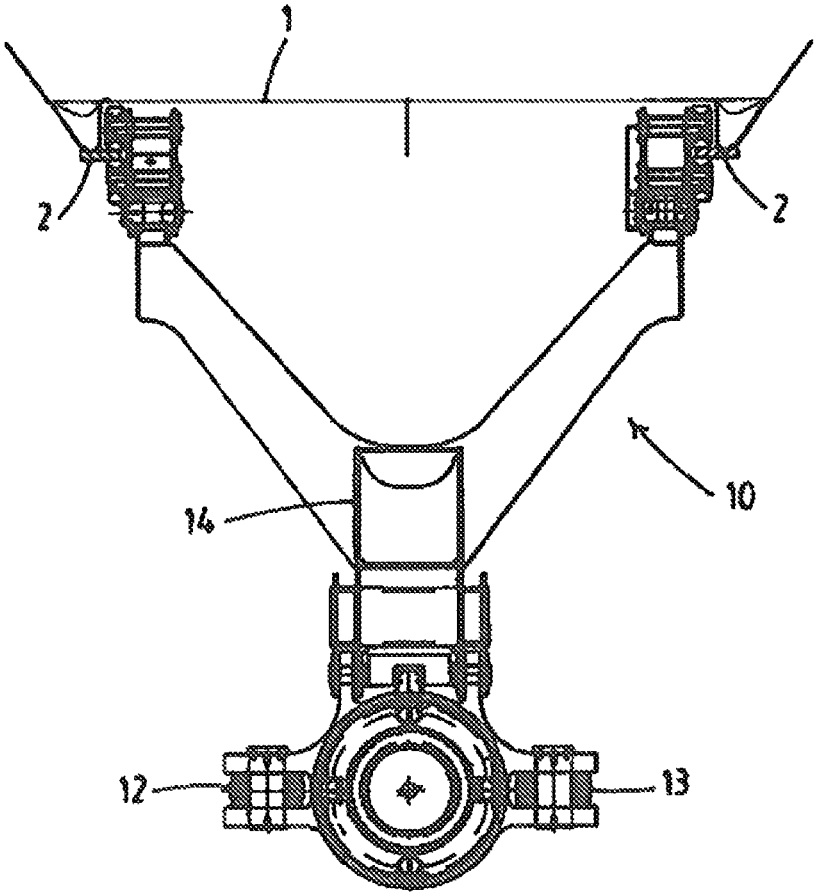
FIG. 7 shows another horizontal section of the top drive system of FIG. 2.
Figure 13:
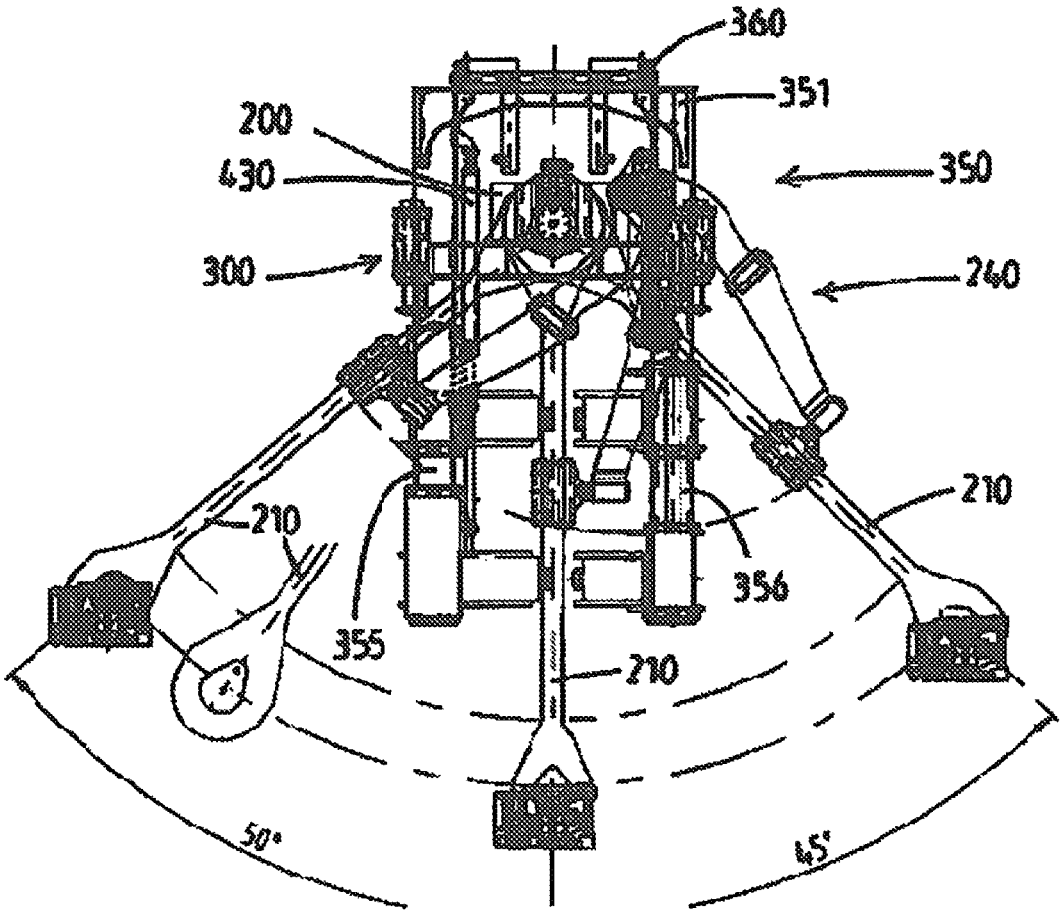
FIG. 13 shows in a side view the slewable leg structure and the elevator mechanism of the top drive system of FIG. 2.

An elevator bails tilt mechanism 240 is provided, which is configured to move the elevator bails 210 between a vertical orientation to align the elevator with the firing and one or more tilted orientations, wherein the elevator is remote from the firing line (illustrated in FIGS. 2, 13).

A swivel fluid connector 155 is provided at the top end of the floating quill shaft 150, allowing for transfer of fluid, e.g. drilling mud, into the hollow quill shaft 150, which fluid then travels through the hollow inner main shaft 190 into the hollow tubular drilling string B during a wellbore related operation, e.g. during drilling.

Figure 10:
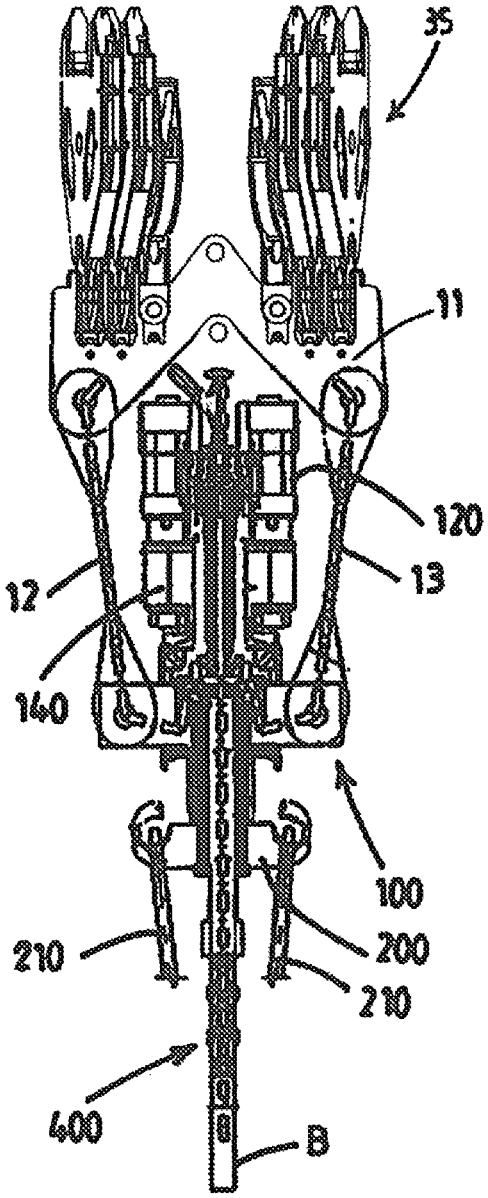
FIG. 10 illustrates the load path through the inner main shaft.

FIG. 10 illustrates a method for drilling a wellbore, e.g. a subsea wellbore, wherein use is made of the top drive system 100. Here a drilling tubulars string B is connected to the assembly of the interconnected floating quill shaft 150 and the inner main shaft 190 so that the one or more top drive motors 120 impart rotary torque to the string B.

In FIG. 10 the assembly of the floating quill shaft 150 and the inner main shaft 190 is in the lowered position (see e.g. FIG. 9 for more detail), whereby the cooperating axial load support faces 184,194 are engaged. Hereby a drilling operation load path is established, indicated by lines of grey rectangle in the figure, wherein a load, e.g. a weight, of the drilling tubular string B passes via the inner main shaft 190 (here via the intermediate valve arrangement 400), the cooperating axial load support faces 184,194, the upper section of the outer main shaft 180, and the thrust bearing 175 into the thrust bearing housing 170. From this housing 170 the load passes via the first and second vertical frame members 12, 13 to the top frame member 11 of the trolley and thereby via the sheaves 36 to the one or more cables 30 of the main hoisting device. This drilling operation load path avoids the transmission and the motors 120.

Figure 11:
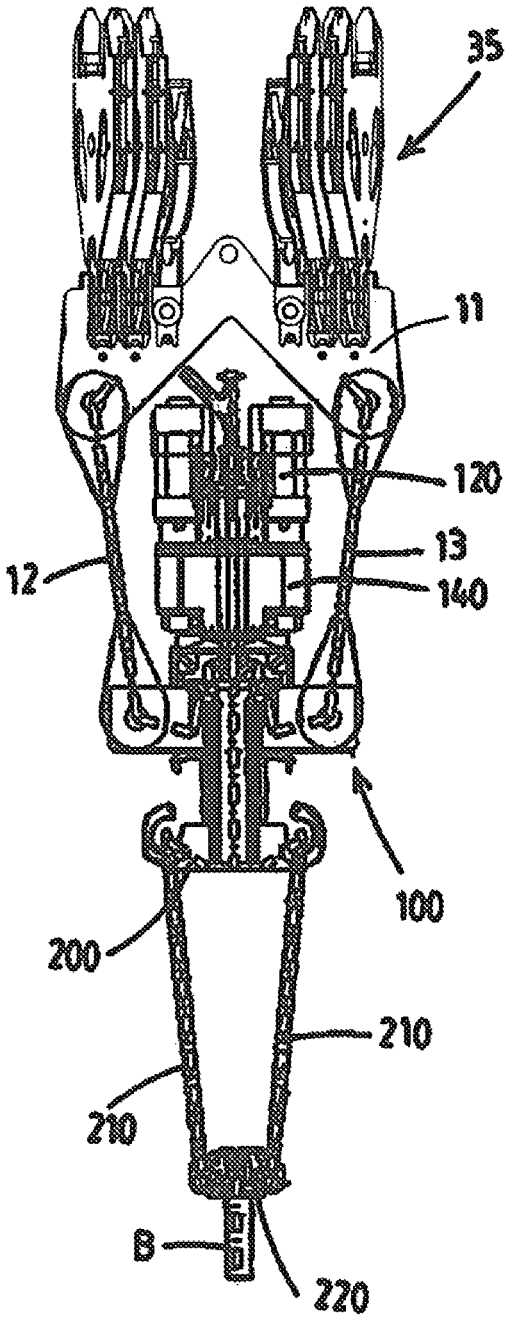
FIG. 11 illustrates the load path through the outer main shaft.

FIG. 11 illustrates a method for tripping a drilling tubulars string B of which an uppermost section is suspended from elevator 220. As is known, tripping is done to move a string B into or out of a wellbore, e.g. in view of maintenance of a bottomhole assembly fixed at the lower end of the string B, etc.

During tripping use is made of the elevator 220 that engages the uppermost end of the string B. The elevator 220 is suspended via elevator bails 210 from the elevator bails carrier 200 of the top drive system. A tripping operation load path is established, wherein a load, e.g. a weight, of the drilling tubular string B passes via the elevator 220, the elevator bails 210, the elevator bails carrier 200, the outer main shaft 180, and the thrust bearing 175 into the thrust bearing housing 170. The first and second vertical frame members 12, 13 pass the load on to the top frame member 11. Via the sheaves 36 the load is passed to the one or more cables 30 of the main hoisting device. This tripping operation load path avoids the transmission and the motors 120.

Figure 14:
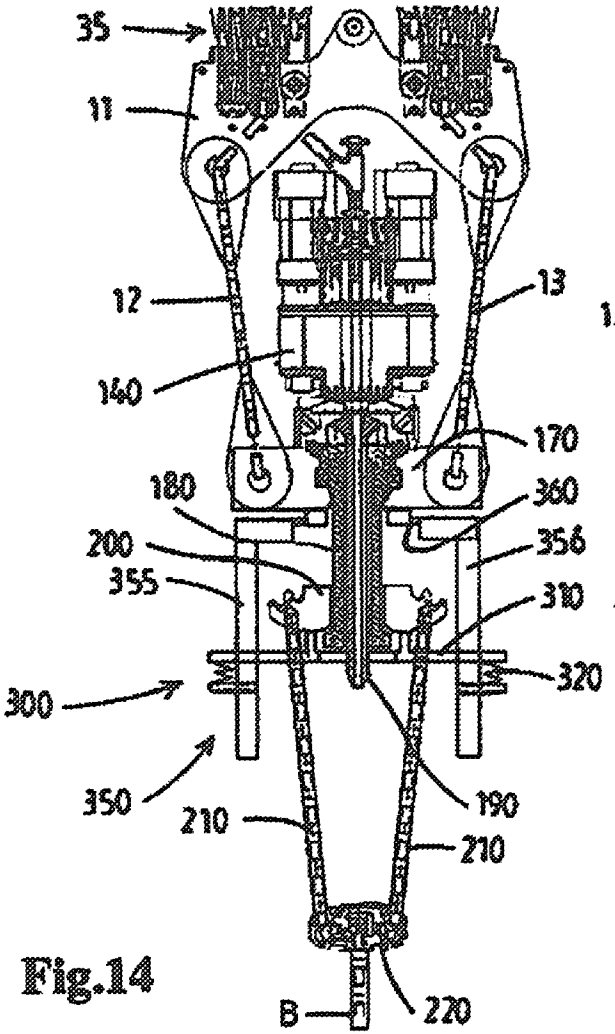
FIG. 14 shows schematically only the operation of the lifting arrangement of the elevator bails carrier when the vertical load thereon is below a threshold value.
Figures 16, 17:
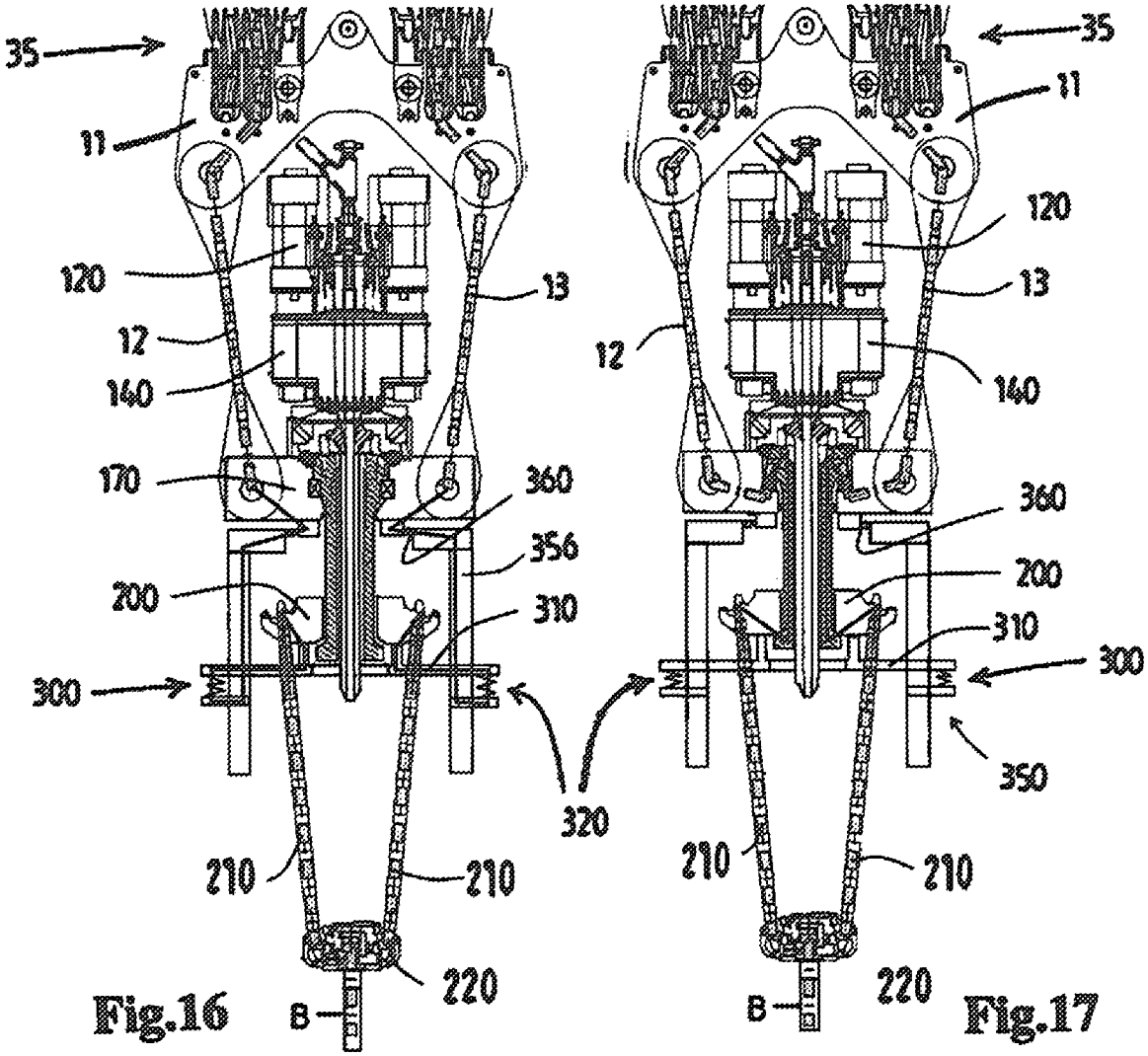
FIG. 16 shows the view of FIG. 14, wherein the third load path via the lifting arrangement for the elevator bails carrier, the slewable leg structure, the associated slew bearing, to the thrust bearing housing is illustrated.
FIG. 17 shows the view of FIG. 15, wherein the load path from the elevator bails carrier, the outer main shaft, the thrust bearing, to the thrust bearing housing is illustrated.

FIGS. 14-17 illustrate the functionality of the lifting arrangement 300. As explained the spring arrangement 320 normally urges the lifting frame member 310, and thereby the elevator bails carrier 200, into a lifted position thereof relative to the outer main shaft 180. Hereby the cooperating axial load support faces of the elevator bails carrier 200 and the outer main shaft 180 are disengaged when the vertical load on the elevator bails carrier is below a threshold value. This is shown in FIGS. 14, 16. For example, the threshold value is a load of 50 tonnes, e.g. within the load rating of the slew bearing 360.

When said vertical load by string B is above a threshold value the spring arrangement 320 gives way, e.g. springs 320 being compressed or extended, so that then the load support faces 182, 202 become engaged. This is shown in FIGS. 15, 17.

This arrangement effectively creates a third load path option of the top drive system 100, namely in case the lifting arrangement 300 causes disengagement of these axial load support faces 182, 202 of the elevator bails carrier and the outer main shaft. In this third load path option, as illustrated in FIG. 16, the vertical load acting on the elevator bails carrier 200, caused by the elevator system being in use, passes via the lifted carrier 200, the lifting arrangement 300, the slewable leg structure 350, the slew bearing 360 of said slewable leg structure, into the thrust bearing housing 170. A part of this load part is shown by grey rectangular block and a part in a solid thick black lines. As explained above, the load then passes via frame members 12, 13 to top member 11.

Figure 15:
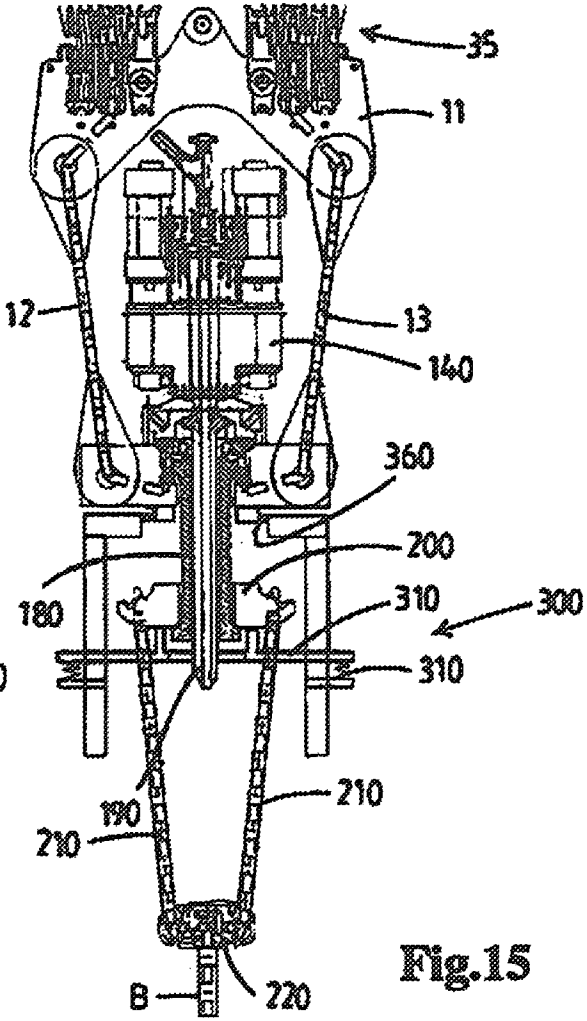
FIG. 15 shows schematically only the operation of the lifting arrangement of the elevator bails carrier when the vertical load thereon is above a threshold value.

FIGS. 15, 17 show the situation wherein the load exerted on the carrier 300 is above the threshold value. Now the load passes from the carrier 200, the mating load support faces 182, 202, the outer shaft 180, the thrust bearing 175, into the housing 170. A part of this load part is shown by grey rectangular block and a part in a solid thick black lines. As explained above, the load then passes via frame members 12, 13 to top member 11.

Figure 18:
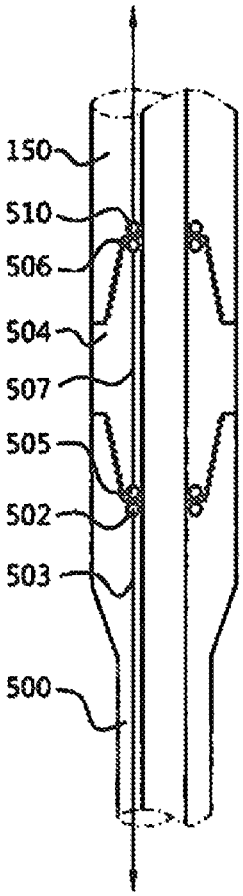
FIG. 18 illustrates the use of a wired drilling tubulars string during drilling operation.
Figure 19:
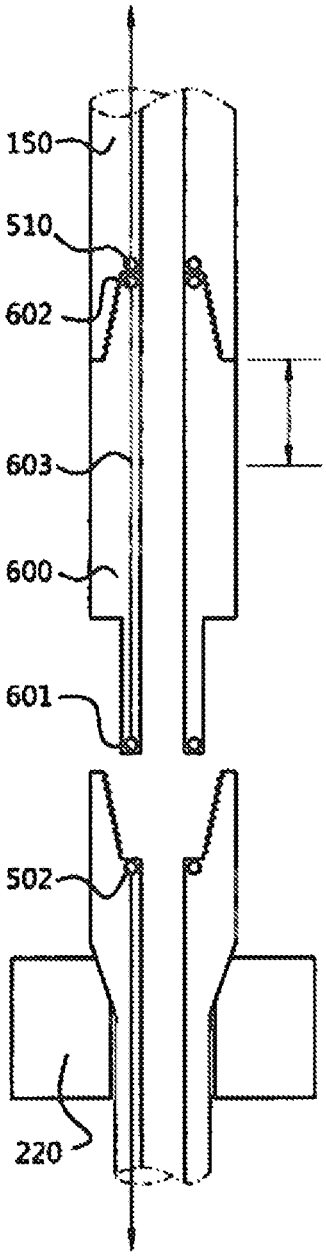
FIGS. 19 and 20 illustrate the provision of an inductive coupler at the lower end of a floating quill or floating quill assembly of a top drive device and the mating thereof with the upper end of an uppermost drilling string tubular retained by an elevator.
Figure 20:
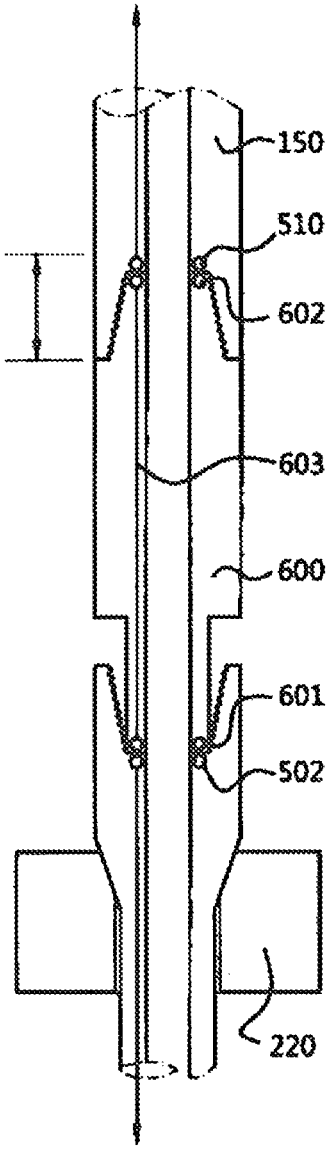

With reference to FIGS. 18, 19, and 20 the second aspect of the invention will now be elucidated.

FIG. 18 schematically shows an upper end of an uppermost tubular 500, e.g. drill pipe, during a drilling operation. As known the uppermost tubular 500, as all tubulars in the string, has one or more induction coils 502 at either end thereof and a wire 503 interconnecting the coils at both ends. For example, as here, the coil 503 is located within the lower end of the threaded box portion of the tubular 500.

FIG. 18 illustrates that a wired drilling operation saver sub 504 is provided, having coils 505, 506 at opposite ends and wire 507 in between the coils. The saver sub 504 is threaded to the box portion of the tubular at the lower end. The upper end of the saver sub 504 is threaded to the lower end of a floating quill, or an inner main shaft 190 extending said floating quill, or any valve arrangement underneath the floating quill shaft 150. This floating structure is provided with yet another coil 510, that inductively communicates with coil 506.

During tripping the floating quill 150 is not required, mostly, to impart rotary torque to the drilling tubulars string. Therefore, it is envisaged that for tripping the functionality afforded by wired drilling tubulars string can be upheld in another manner.

FIG. 19 shows that a tripping operation inductive coupler 600 is fitted to the floating structure. This coupler 600 has a lower end that is not threaded, and is operable to be moved into and out of engagement with the coil 502 of tubular 500 without necessitating a screw motion. The coupler 600 has a coil 601 at its lower end that is in close proximity of the coil 502 when the coupler 600 is inserted into the box portion of the tubular due to operation of the actuators 160 associated with the floating structure of the top drive device. This insertion is illustrated in FIG. 20. The coupler 600 has another coil 602 at the upper end, linked by wire 603 to coil 601.

The invention claimed is:

1. A top drive system for drilling a wellbore and other wellbore related activities involving a drilling tubulars string, said top drive system comprising:

a frame structure adapted to support a load formed by a drilling tubulars string that passes along a firing line to or into a wellbore, a top drive device comprising:

one or more top drive motors adapted to impart a rotary torque to the drilling tubulars string, a transmission housing accommodating a transmission to which said one or more top drive motors are connected, a floating quill system comprising a hollow vertical floating quill shaft that is vertically mobile relative to the transmission housing whilst in engagement with the transmission allowing the floating quill shaft to be driven by said one or more top drive motors, said floating quill system further comprising one or more floating quill shaft vertical displacement actuators configured to cause controlled vertical motion of the floating quill shaft, at least during a make up and/or a breaking of a threaded connection to the drill tubulars string, a thrust bearing housing arranged below the transmission housing and suspended from the frame structure, said thrust bearing housing being provided with a thrust bearing configured to support the load of the drilling tubulars string, a hollow vertical outer main shaft which is suspended from the thrust bearing housing via said thrust bearing so as to be rotational relative to said thrust bearing housing, said outer main shaft having a portion that extends below said thrust bearing housing, a hollow vertical inner main shaft which is arranged vertically mobile within the outer main shaft, wherein the inner main shaft is connected to the floating quill shaft so as to move vertically along with the floating quill shaft and so as to rotate along with the floating quill shaft when driven by the one or more top drive motors, wherein the inner main shaft has a lower connector end that is configured to be connected to the drilling tubulars string via a threaded connection so as to allow for transmission of the rotary torque from the one or more top drive motors via the transmission, the floating quill shaft, the inner main shaft, and the threaded connection to the drilling tubular string, wherein the inner main shaft, on the one hand, and the outer main shaft, on the other hand, are provided with cooperating axial load support faces, said axial load support faces being engaged in a lowered position of the assembly of the floating quill shaft and the inner main shaft relative to the outer main shaft and said axial load support faces being disengaged in a raised position of said assembly of the floating quill shaft and the inner main shaft relative to the outer main shaft, wherein the outer main shaft is provided with an elevator bails carrier that is configured to carry elevator bails.

2. The top drive system according to claim 1, wherein the elevator bails carrier is rotationally mounted relative to the outer main shaft, and wherein a coupling mechanism is provided that allows to selective engage and disengage the elevator bails carrier from rotating together with the outer main shaft.

3. The top drive system according to claim 2, wherein the elevator bails carrier is rotationally mounted on the outer main shaft, and wherein said axial load support faces are present on the elevator bails carrier and the outer main shaft respectively, and wherein a coupling mechanism that is effective between the elevator bails carrier and the main outer shaft comprises a lifting arrangement acting on the elevator bails carrier, which lifting arrangement is configured to selective lift and lower the elevator bails carrier relative to the outer main shaft.

4. The top drive system according to claim 1, wherein the elevator bails carrier is rotationally mounted on the outer main shaft, and wherein said axial load support faces are present on the elevator bails carrier and the outer main shaft respectively, and wherein a coupling mechanism that is effective between the elevator bails carrier and the main outer shaft comprises a lifting arrangement acting on the elevator bails carrier, which lifting arrangement is configured to selective lift and lower the elevator bails carrier relative to the outer main shaft.

5. The top drive system according to claim 4, wherein the slewable leg structure is provided with said lifting arrangement, wherein the lifting arrangement comprises a lifting frame member that extends underneath the elevator bails carrier, which lifting frame member is vertically mobile secured to the one or more vertical legs of the slewable leg structure.

6. The top drive system according to claim 5, wherein the lifting frame member is secured to the slewable leg structure by means of a spring arrangement that normally urges the lifting frame member, and thereby the elevator bails carrier, into a lifted position thereof.

7. The top drive system according to claim 1, wherein the top drive system further comprises a slewable leg structure having a head and one or more vertical legs depending from said head, which leg structure extends from the thrust bearing housing downwards, and wherein between the head of the leg structure on the one hand and the thrust bearing housing on the other hand a slew bearing is arranged that allows for the leg structure to be slewable about the vertical axis of the inner main shaft of the top drive device.

8. The top drive system according to claim 7, wherein a slew drive is provided between the slewable leg structure and the thrust bearing housing, wherein one or more slew drive motors are mounted on the thrust bearing housing and the head of the slewable leg structure is provided with a slew gear member extending about the vertical axis of the inner main shaft.

9. The top drive system according to claim 7, wherein a backup clamp is mounted on the slewable leg structure.

10. The top drive system according to claim 7, wherein the slewable leg structure is provided with said lifting arrangement, wherein the lifting arrangement comprises a lifting frame member that extends underneath the elevator bails carrier, which lifting frame member is vertically mobile secured to the one or more vertical legs of the slewable leg structure.

11. The top drive system according to claim 1, wherein a slew drive mechanism is provided between the thrust bearing housing and the elevator bails carrier, which slew drive mechanism is configured to cause a controlled slew motion of the elevator bails carrier relative to the thrust bearing housing about the vertical axis of the inner main shaft.

12. The top drive system according to claim 1, wherein a valve arrangement is secured to the lower connector end of the inner main shaft, said valve arrangement comprising one or more valves that are configured to control a fluid flow through the drilling tubular string.

13. The top drive system according to claim 1, wherein the transmission housing and the one or more top drive motors are placed on top of the thrust bearing housing.

14. The top drive system according to claim 1, wherein the connection between the inner main shaft and the floating quill shaft is a releasable threaded connection and wherein the transmission housing is releasably mounted on top of the thrust bearing housing allowing for removal of the transmission housing once the releasable connection between the floating quill shaft and the inner main shaft has been undone.

15. The top drive system according to claim 1, wherein the transmission comprises a main gear member having a vertical central splined bore through which the quill shaft extends, wherein a section of the quill shaft is splined, the splines of the gear member and the quill shaft meshing, and wherein the one or more top drive motors drive the main gear member.

16. The top drive system according to claim 1, wherein the one or more top drive motors are electric motors having a stator housing and a rotor, and wherein each top drive motor is provided with an operable clutch device configured to selectively connect and disconnect upon command the rotor of the motor relative to the transmission.

17. A method for drilling a wellbore, wherein use is made of a top drive system of claim 1, and wherein a drilling tubulars string is connected to the assembly of the floating quill shaft and the inner main shaft so that the one or more top drive motors impart rotary torque to the string, and wherein the assembly of the floating quill shaft and the inner main shaft is in a lowered position, whereby the cooperating axial load support faces are engaged, so that a drilling operation load path is established, wherein a load of the drilling tubular string passes via the inner main shaft, the cooperating axial load support faces, the outer main shaft, and the thrust bearing into the thrust bearing housing, and then to the frame structure.

18. A method for tripping a drilling tubulars string, wherein use is made of a top drive system of claim 1, and wherein during tripping of a drilling tubulars string use is made of an elevator that is suspended via elevator bails from the elevator bails carrier of the top drive system, and wherein an uppermost section of the drilling tubulars string is suspended from the elevator, so that a tripping operation load path is established, wherein a load of the drilling tubular string passes via the elevator, the elevator bails, the elevator bails carrier, the outer main shaft, and the thrust bearing into the thrust bearing housing, and then to the frame structure.

* * * * *